US009303415B1

(12) United States Patent
Cipriano

(10) Patent No.: US 9,303,415 B1
(45) Date of Patent: Apr. 5, 2016

(54) METHOD, APPARATUS, AND SYSTEM FOR MEASURING CUTS

(71) Applicant: Chris Cipriano, Cranston, RI (US)

(72) Inventor: Chris Cipriano, Cranston, RI (US)

( * ) Notice: Subject to any disclaimer, the term of this patent is extended or adjusted under 35 U.S.C. 154(b) by 0 days.

(21) Appl. No.: 14/019,484

(22) Filed: Sep. 5, 2013

Related U.S. Application Data

(63) Continuation-in-part of application No. 29/441,907, filed on Jan. 10, 2013, now Pat. No. Des. 706,652.

(60) Provisional application No. 61/697,146, filed on Sep. 5, 2012.

(51) Int. Cl.
*G01B 3/14* (2006.01)
*E04F 21/00* (2006.01)

(52) U.S. Cl.
CPC ..... *E04F 21/0076* (2013.01)

(58) Field of Classification Search
CPC ..... B25H 7/00; B43L 13/20; G01B 3/14
USPC ..... 33/1 B, 526, 527, 562, 563, DIG. 20
See application file for complete search history.

(56) References Cited

U.S. PATENT DOCUMENTS 3,548,505 A * 12/1970 Candilo ..... 33/527
4,498,238 A 2/1985 Vaughn
4,503,618 A * 3/1985 Eberhardt ..... 33/430
5,471,749 A * 12/1995 Brady ..... 33/562
5,491,902 A 2/1996 Uhrin et al.
5,557,996 A 9/1996 Reber et al.
5,579,670 A * 12/1996 McCormick ..... 83/56
5,673,490 A 10/1997 Hill
5,922,157 A 7/1999 Snider
6,049,987 A 4/2000 Robell
6,834,438 B1 12/2004 Heister
7,178,249 B2 2/2007 Schafer
2006/0005910 A1* 1/2006 Jones ..... 33/526
2006/0191150 A1* 8/2006 Sikora et al. ..... 33/566
2006/0283026 A1* 12/2006 Lockyer ..... 33/1 B
2007/0175052 A1* 8/2007 Schafer et al. ..... 33/1 B
2013/0306633 A1* 11/2013 Belinda et al. ..... 220/212
2014/0283401 A1* 9/2014 Kufner et al. ..... 33/527

* cited by examiner

*Primary Examiner* — G. Bradley Bennett
(74) *Attorney, Agent, or Firm* — Adler Pollock & Sheehan P.C.; Daniel J. Holmander, Esq.; George N. Chaclas, Esq.

(57) ABSTRACT

A measuring apparatus is provided for measuring cuts of a working material. The measuring apparatus may include: tracing sheets, one or more pins, or a jig member. The one or more transparent tracing sheets are configured for marking a cut area. The one or more pins are configured to engage the tracing sheets proximal to the cut area. In one embodiment, the jig member includes one or more cylinder mounts and one or more spring clamps. The one or more transparent tracing sheets are configured for receipt within the one or more spring clamps. The one or more pins are configured for receipt within the one or more cylinder mounts. In operation, the pins and jig member engage proximal to a cut area to facilitate marking an outline of the cut area on the tracing sheets which are subsequently cut and used in measuring and cutting of the working material.

20 Claims, 61 Drawing Sheets

METHOD, APPARATUS, AND SYSTEM FOR MEASURING CUTS

CROSS REFERENCE TO RELATED APPLICATIONS

This application is related to and claims priority from earlier filed U.S. Provisional Patent Application No. 61/697,146 filed Sep. 5, 2012, continuation-in-part of earlier filed U.S. Design patent application Ser. No. 29/441,907 filed Jan. 10, 2013, the entire contents of all applications are incorporated herein by reference.

BACKGROUND

The present disclosure relates to a method, apparatus, and system for measuring, marking, and cutting working material and, more particularly, to a measuring apparatus which allows the user to determine the proper angle, radius, and directional cut of a working material, such as tile or brick.

Tile, brick, and other working materials are available in a number of standardized sizes and shapes. When laying these materials, an outer perimeter of the area being covered oftentimes requires less than a whole standard piece to fill the available space. To fill the non-standard space, the materials must be measured and cut to fit within the available space.

Cutting these working materials to fill non-standard spaces has been typically been performed in the past by trial and error methods. If one cuts away too little material, the working material must be cut again if even possible. Likewise, if one cuts too much material away, then the working material may be discarded. This trial and error method often proves to be time-consuming and wasteful.

Therefore, there remains a need to provide a measuring apparatus and method which makes the process of cutting working materials to fit within non-standard spaces more convenient and easy to perform.

BRIEF SUMMARY OF THE INVENTION

The present invention preserves the advantages of prior art for measuring apparatus. In addition, it provides new advantages not found in currently available measuring apparatus and overcomes many disadvantages of such currently available measuring apparatus.

The present invention is generally directed to a method, apparatus, and system for measuring, marking, and cutting working material and, more particularly, to a measuring apparatus which allows the user to determine the proper angle, radius, and directional cut of a working material, such as tile or brick.

The measuring apparatus may include: tracing sheets, one or more pins, or a jig member. The one or more transparent tracing sheets are configured for marking a cut area. The one or more pins are configured to engage the tracing sheets proximal to the cut area. In one embodiment, the jig member includes one or more cylinder mounts and one or more spring clamps. The one or more transparent tracing sheets are configured for receipt within the one or more spring clamps. The one or more pins are configured for receipt within the one or more cylinder mounts.

In operation, the pins and jig member engage proximal to a cut area to facilitate marking an outline of the cut area on the tracing sheets which are subsequently cut and used in measuring and cutting of the working material. For example, a measuring apparatus comprising one or more transparent tracing sheets, one or more pins, and/or a jig member is provided. The measuring apparatus is engaged proximal to a cut area to be measured. The one or more transparent tracing sheets are marked with a trace line outlining the cut area to use in measuring and cutting of the working material. Next, the one or more transparent tracing sheets are cut along the trace line to provide the tracing sheet in the shape of the cut area. The working material is marked with a cut line outlining the tracing sheet in the shape of the cut area. The working material is cut along the cut line to provide the material in the shape of the cut area.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENTS

In accordance with the invention, a measuring apparatus, method, and system is provided for measuring, marking, and cutting working material and, more particularly, to a measuring apparatus which allows the user to determine the proper angle, radius, and directional cut of the working material, such as tile or brick. The measuring apparatus may include one or more of the following: tracing sheets 10, one or more secure pins 20A, 20B, or a jig member 30A, 30B which shall be explained in more detail below.

Figure 1:
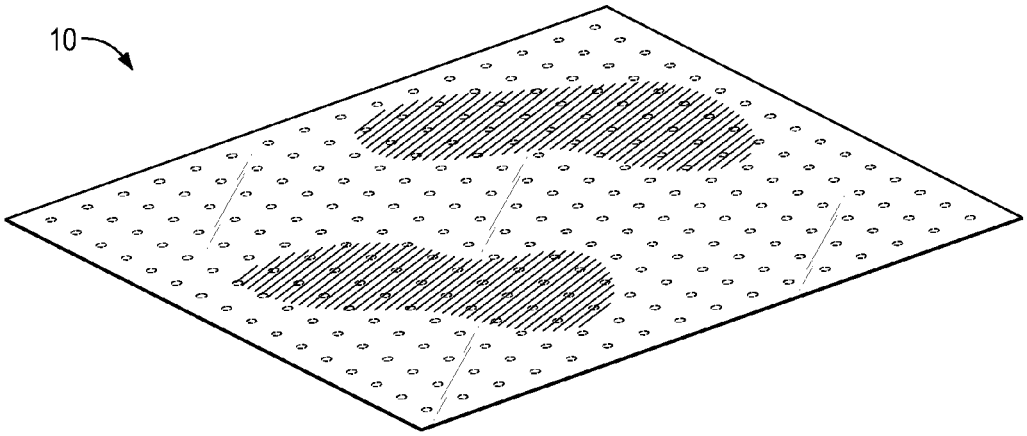
FIG. 1 is a perspective view of an embodiment of the apparatus for measuring cuts.
Figure 64:
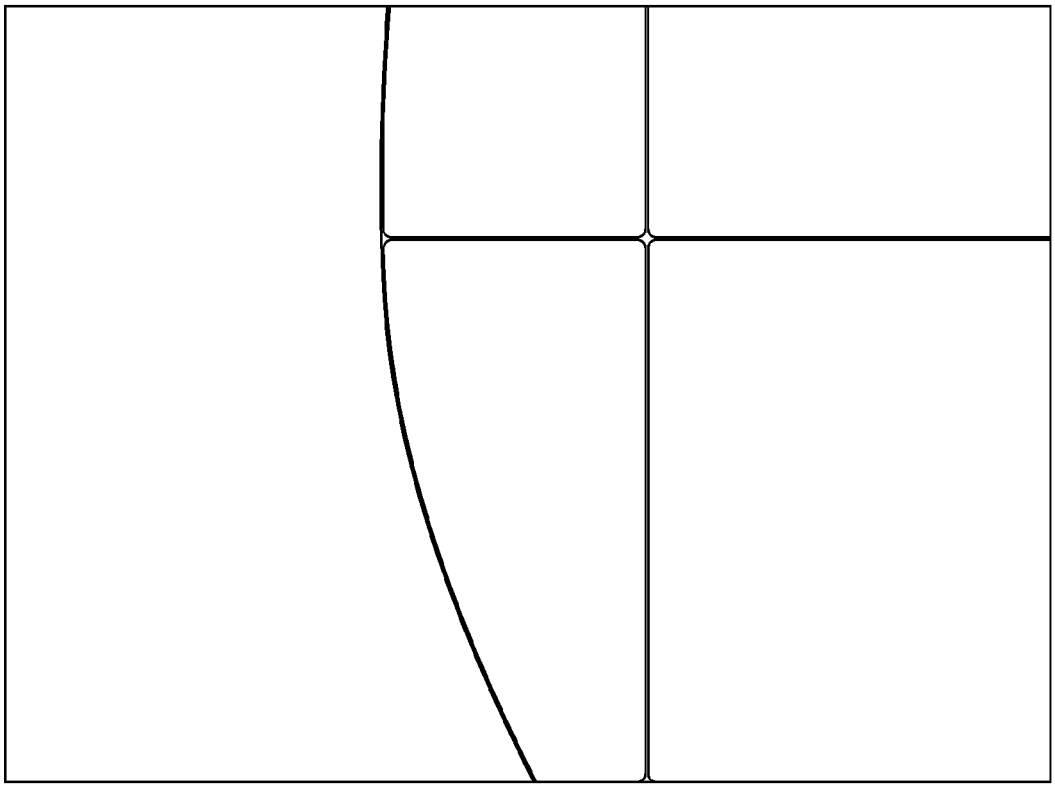

As shown generally in FIGS. 1-64, the measuring apparatus is used for tracing, overlaying, and measuring angled, directional, and radius cuts to create a template or cut sheet from a transparent tracing sheet which is used to mark a material for cutting. The measuring apparatus is used to measure cuts in a variety of working materials including, but not limited to, natural materials, concrete materials, ceramic materials, tile, bricks, stone, paneling, drywall, plywood or other materials used for siding, ground, or floor coverings. It should be noted that any other natural or man-made products that needs to be measured or cut may also be cut using the measuring tool and tracing sheets.

Figure 2:
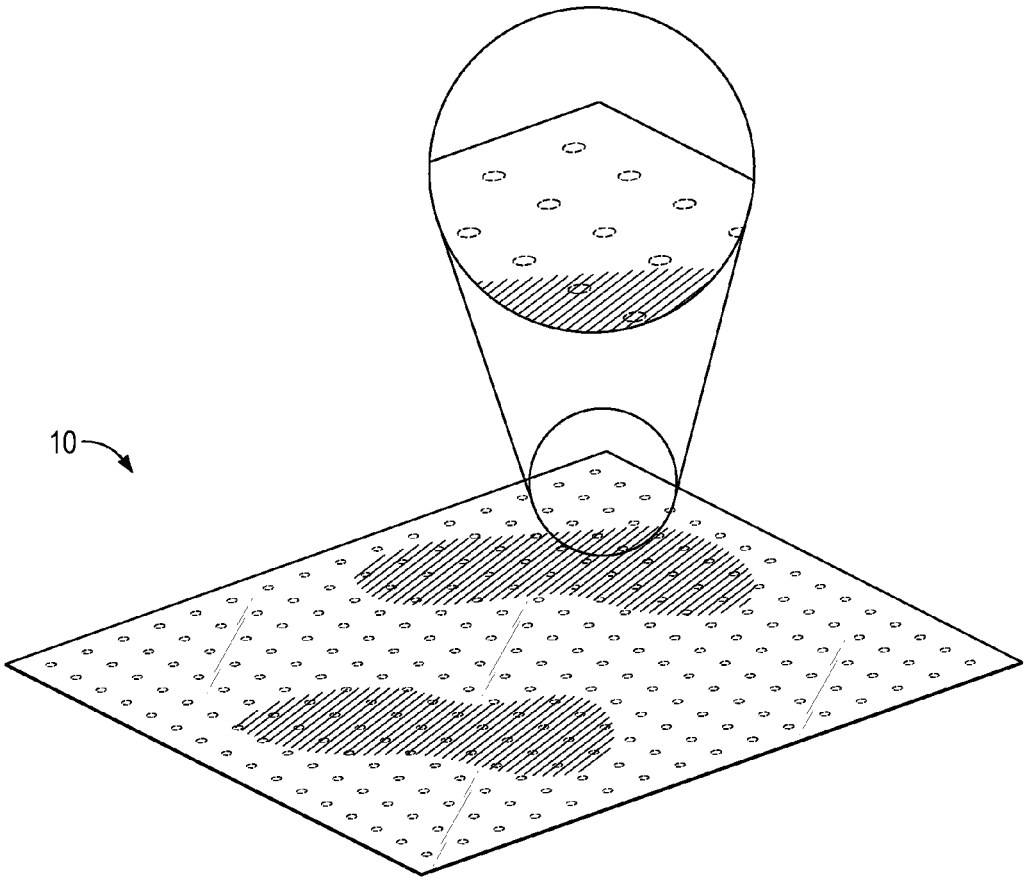
FIG. 2 is a perspective view thereof.
Figure 3:
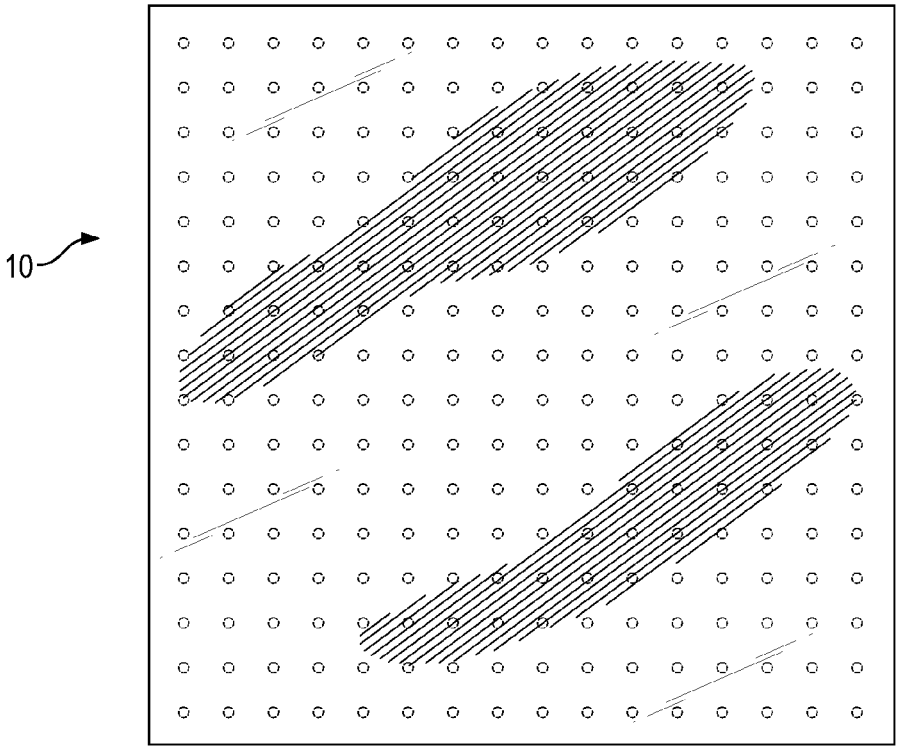
FIG. 3 is a top view thereof.
Figure 20:
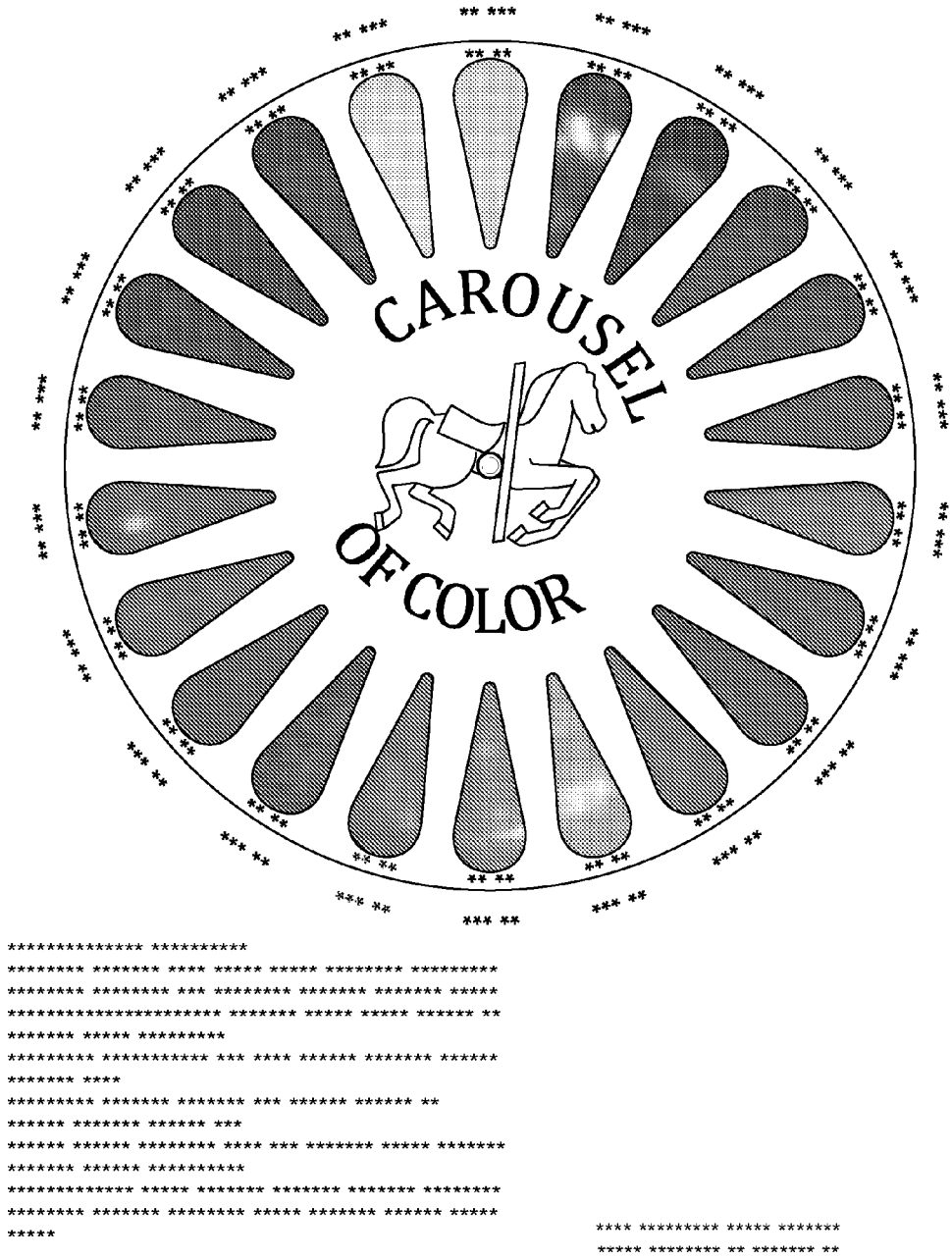
FIG. 20 is a top view of a color wheel demonstrating the different colors and shades of a tracing sheet of the apparatus.
Figure 21:
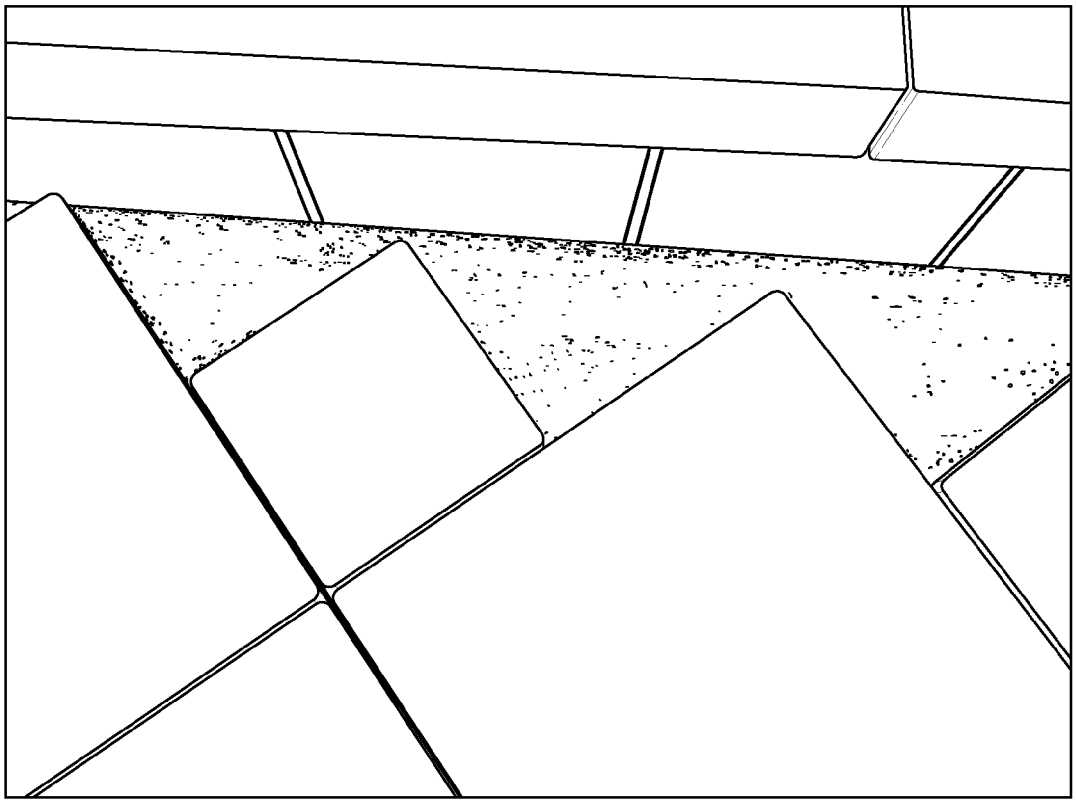
FIGS. 21-30 illustrate how to use the tracing sheets and pins of the apparatus to facilitate a straight line cut.
Figure 22:
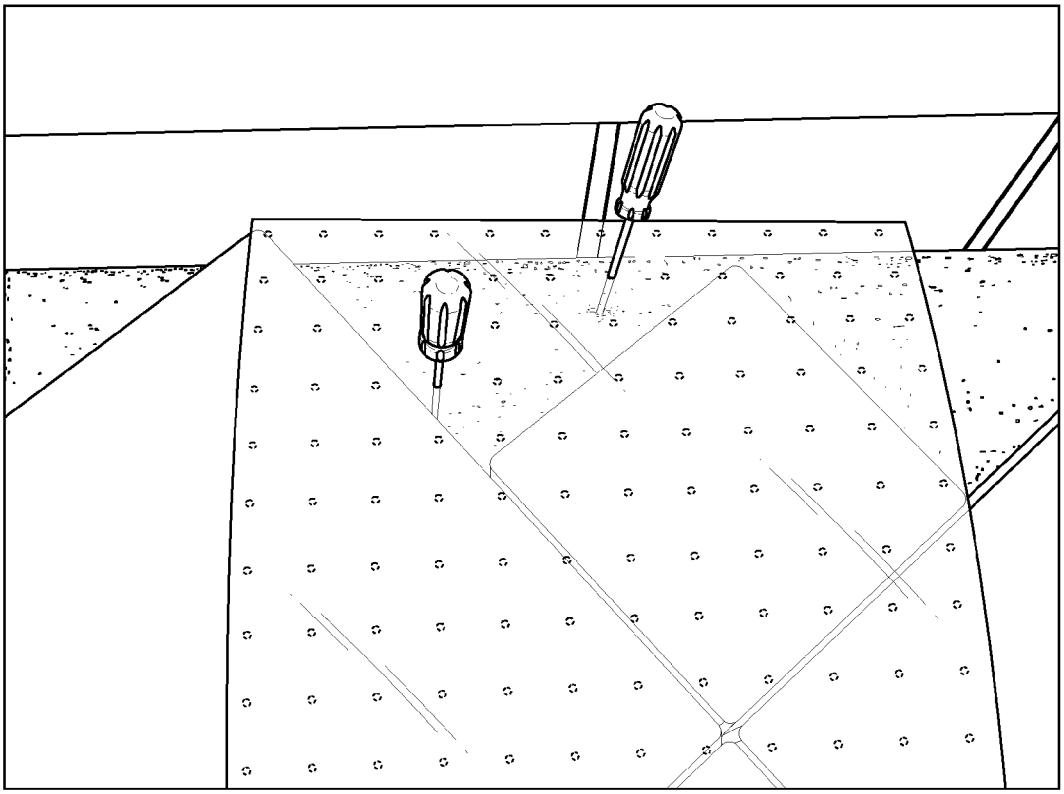

Referring to FIGS. 1-3, the one or more transparent tracing sheets are configured for marking a cut area. In one embodiment, a cut sheet or template is created from the transparent tracing sheet made of transparent plastic, acrylic, or other plastic, polymers, or other acrylic materials used alone or in combination with other materials. The transparent plastic or acrylic materials may be a colored substance that will enable light to pass therethrough. The tracing sheets may also comprise multiple colors. Some colors show thru better than others depending on color of the product being traced. Sunlight and shade also effect visibility. As shown in FIG. 20, the transparent tracing sheets may come in a variety of colors and shades including, but not limited to, clear and cloudy. Of course, the tracing sheets may also be opaque but transparent is preferable to aid in seeing through the tracing sheet and into a target cut area.

The size of the tracing sheets may range in size, thickness, and density of material. In one embodiment, the size of the tracing sheets is 4'×4' to 10'×10' in size and a range of thickness from 0.08 mill. to 0.15 mill. In use the transparent tracing sheet is then overlaid over the proposed cut area and the transparent sheet provides a clear and precise visual image overview of the cut to be made. This image can now be traced or marked onto the tracing sheet by using a marker or other drawing device.

Figure 6:
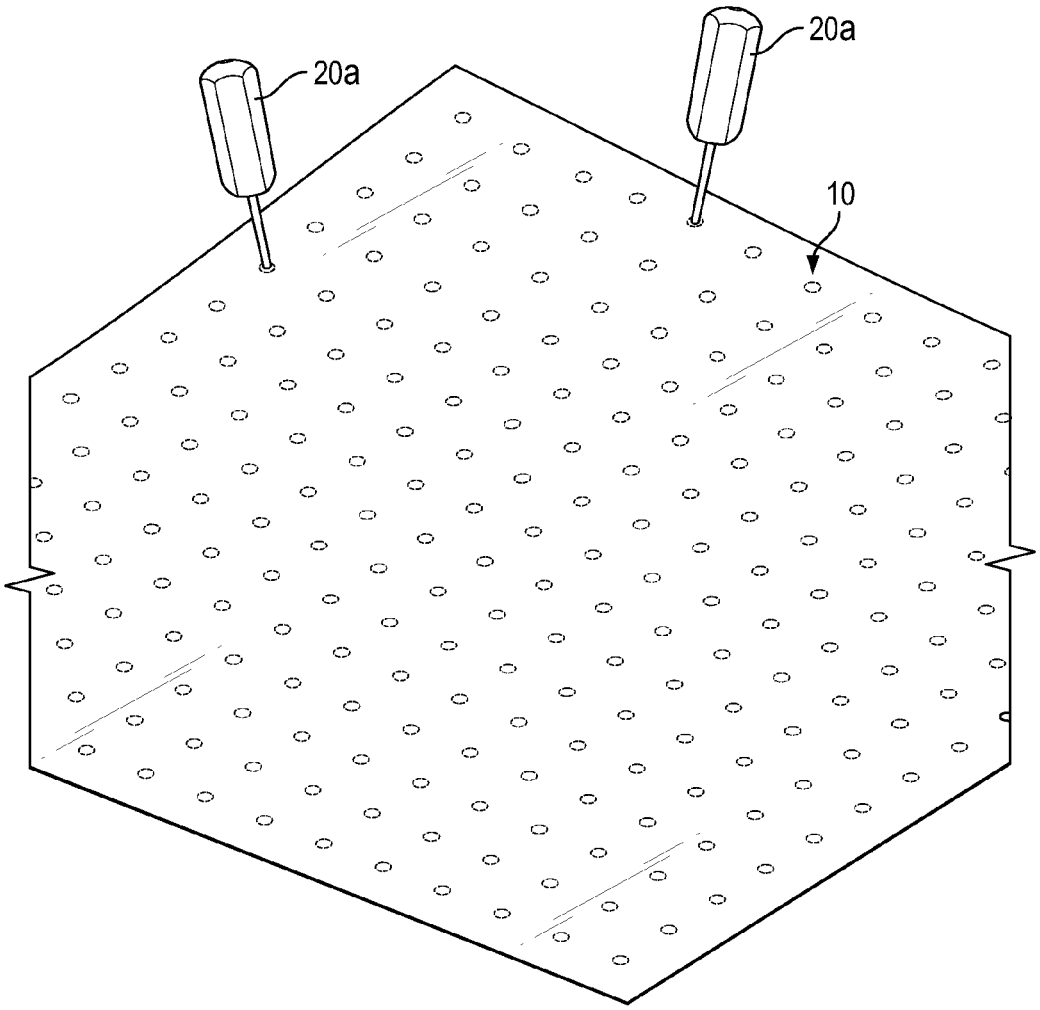
FIG. 6 is a perspective view of another embodiment of the apparatus for measuring cuts.

Referring to FIG. 6, in another embodiment, the one or more pins are configured to engage the tracing sheets proximal to the cut area. The transparent tracing sheet may also have a receiving area consisting of a series of dimples, marks, grooves, recesses, perforations, apertures, or through holes, along or through its surface. The receiving area is configured for receipt of the secure pins or other placeholders to secure the tracing sheet proximal to the cut area. In addition, the receiving area may be used to facilitate the marking or cutting of the tracing sheet.

The transparent tracing sheet can then be cut out by using a scissor, razor knife, or other sharp object to create an exact template of the proposed cut area. Alternatively, the transparent tracing sheet may be scored, perforated or similar to remove the necessity of cutting with scissors or other sharp objects. This template is then placed on top of the necessary product to be cut and is outlined with a marker. It should also be noted that the transparent tracing sheet may be made of materials other than plastic.

Figure 4:
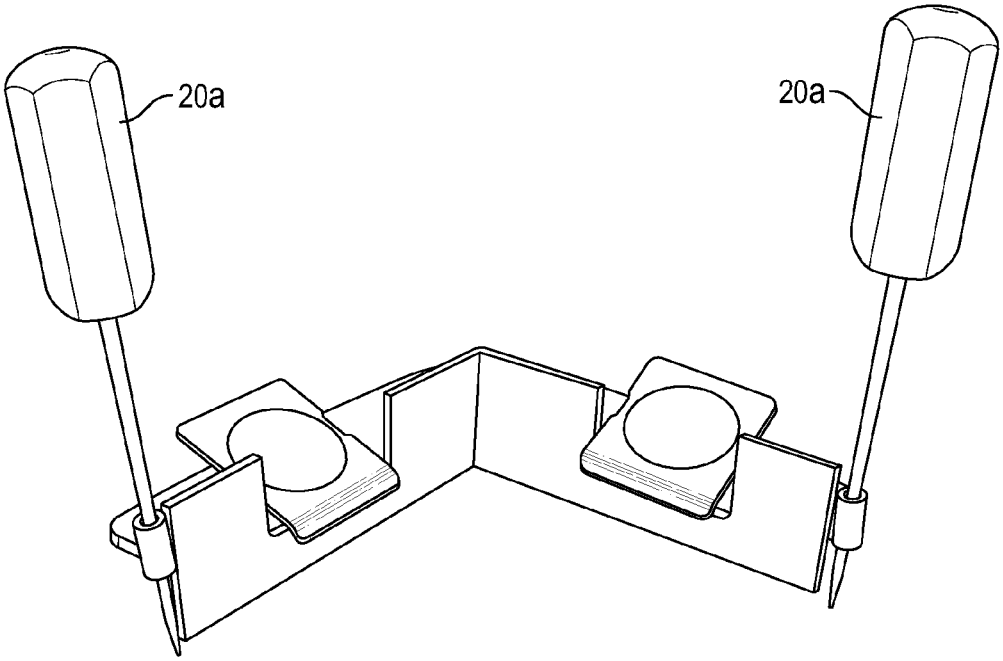
FIG. 4 is a perspective view of another embodiment of the apparatus for measuring cuts.
Figure 5:
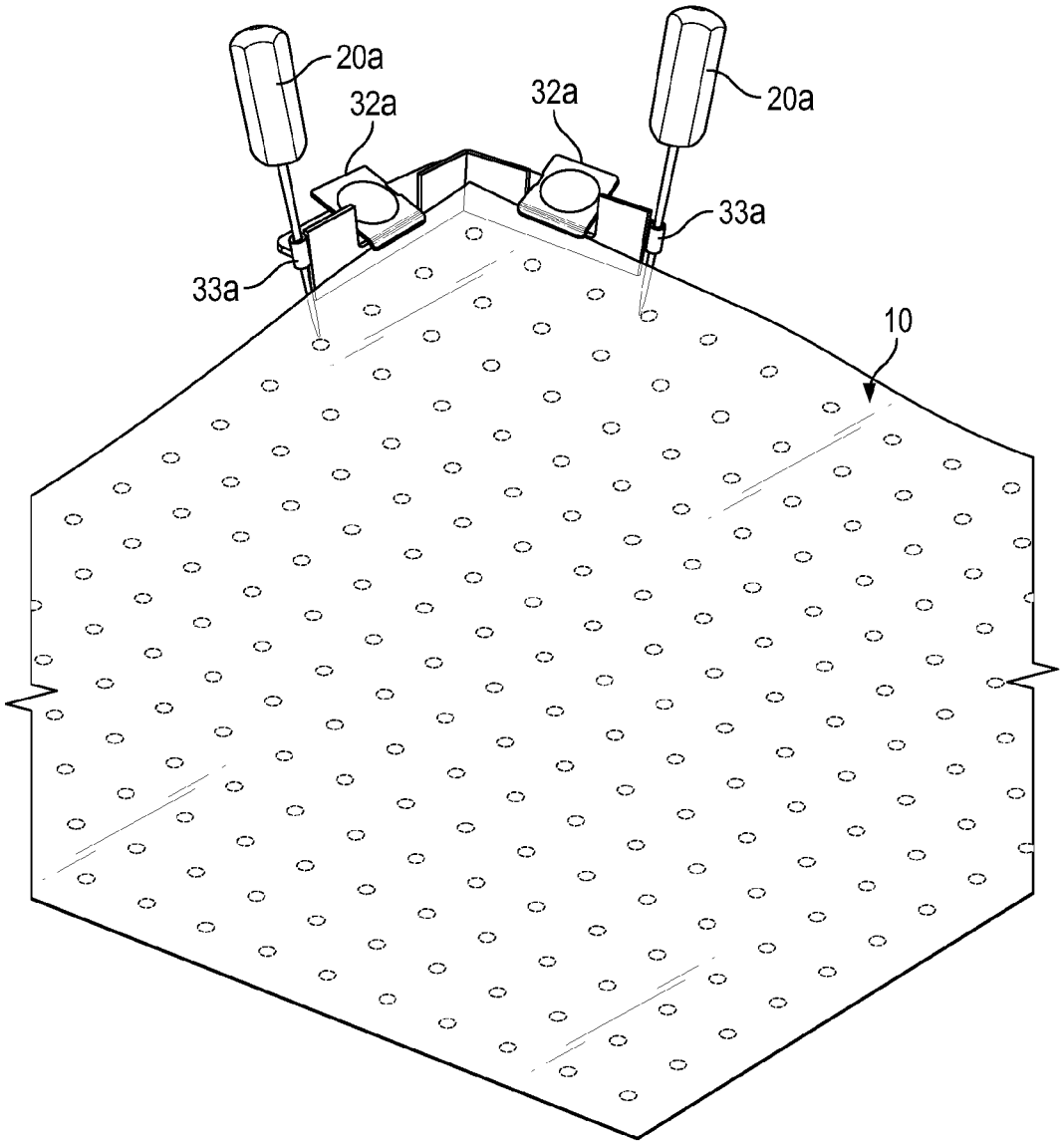
FIG. 5 is a perspective view of another embodiment of the apparatus for measuring cuts in accordance with the invention.

Referring to FIGS. 4-5, the jig member 30A is illustrated with a 90 degree angle design but, in alternative embodiments, may include angles greater than or less than a 90 degree angle. The jig member 30A includes one or more cylinder mounts and one or more spring clamps 32A. The one or more secure pins are configured for receipt within the one or more cylinder mounts 33A. The jig member 30A, in one embodiment, has one or more, preferably two, cylinder mounts 33A which are located at the top left and lower right corners of the jig member 30A. These cylinders mount 33A the secure pins 20A in place, however, the pins 20A are may or may not be fixed to the cylinder.

The secure pins 20A are designed to be removable and must have upward and downward motion. The secure pins are constructed with a plastic handle which allows the pins to be inserted by hand or hammered into place. The secure pins may be manipulated by a user or other mechanism for moving the secure pins along a vertical axis within the cylinder mount. The steel shaft and has a sharp point which can be sharpened as needed. This point can be driven thru gravel, wall board, flooring, or any other surface area proximal to the cutting area.

In one embodiment, the secure pins may be frictionally fit or spring-biased within the mounts to retain the pins within the cylinder mounts. For example, the secure pins may be spring-biased whereby the secure pins are lifted up and rotated into a desired position. In another example, the secure pins and/or an interior of the cylinder mount are indented to provide a friction fit within the cylinder at a desired position.

Figure 7:
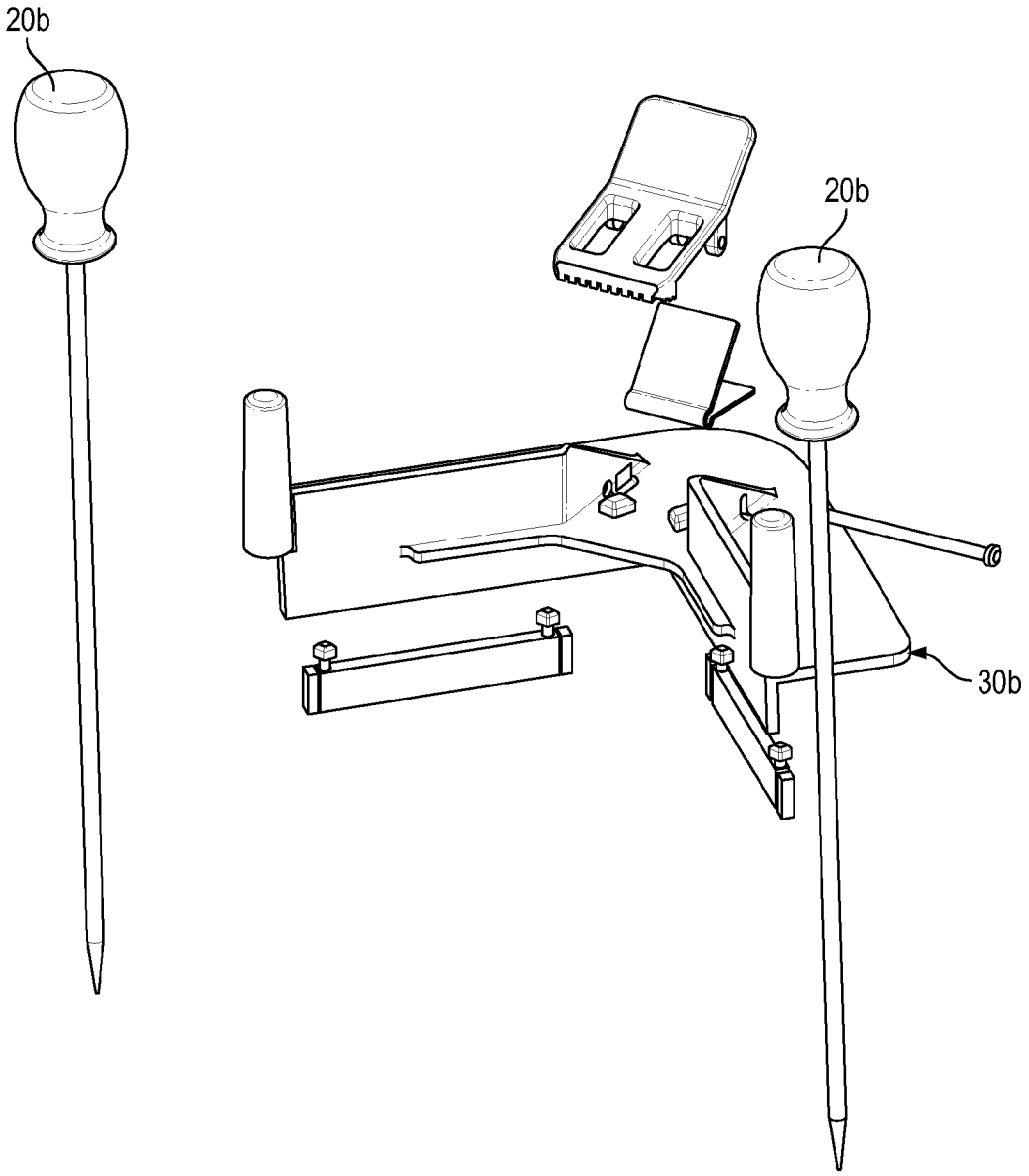
FIG. 7 is a an exploded view of another embodiment of the apparatus for measuring cuts.
Figure 8:
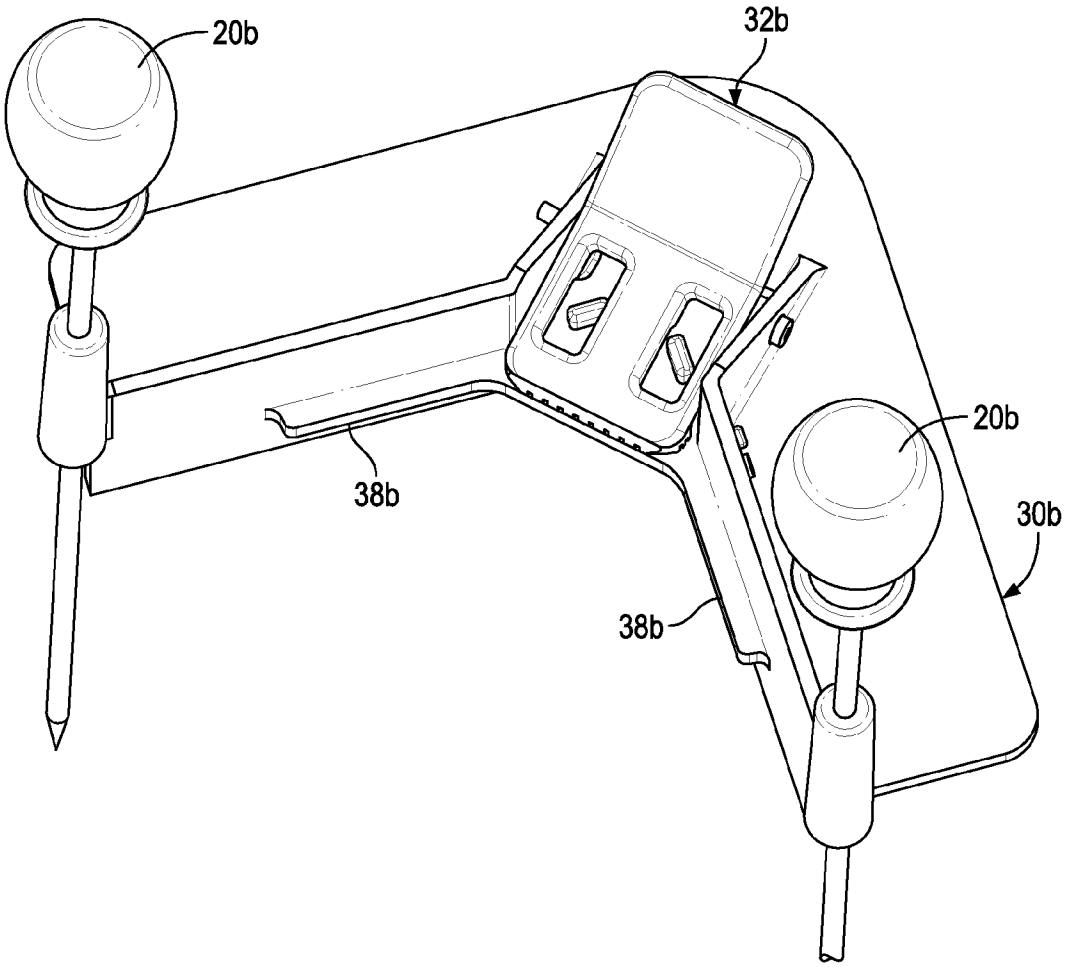
FIG. 8 is a perspective view of the apparatus of FIG. 7.
Figure 9:
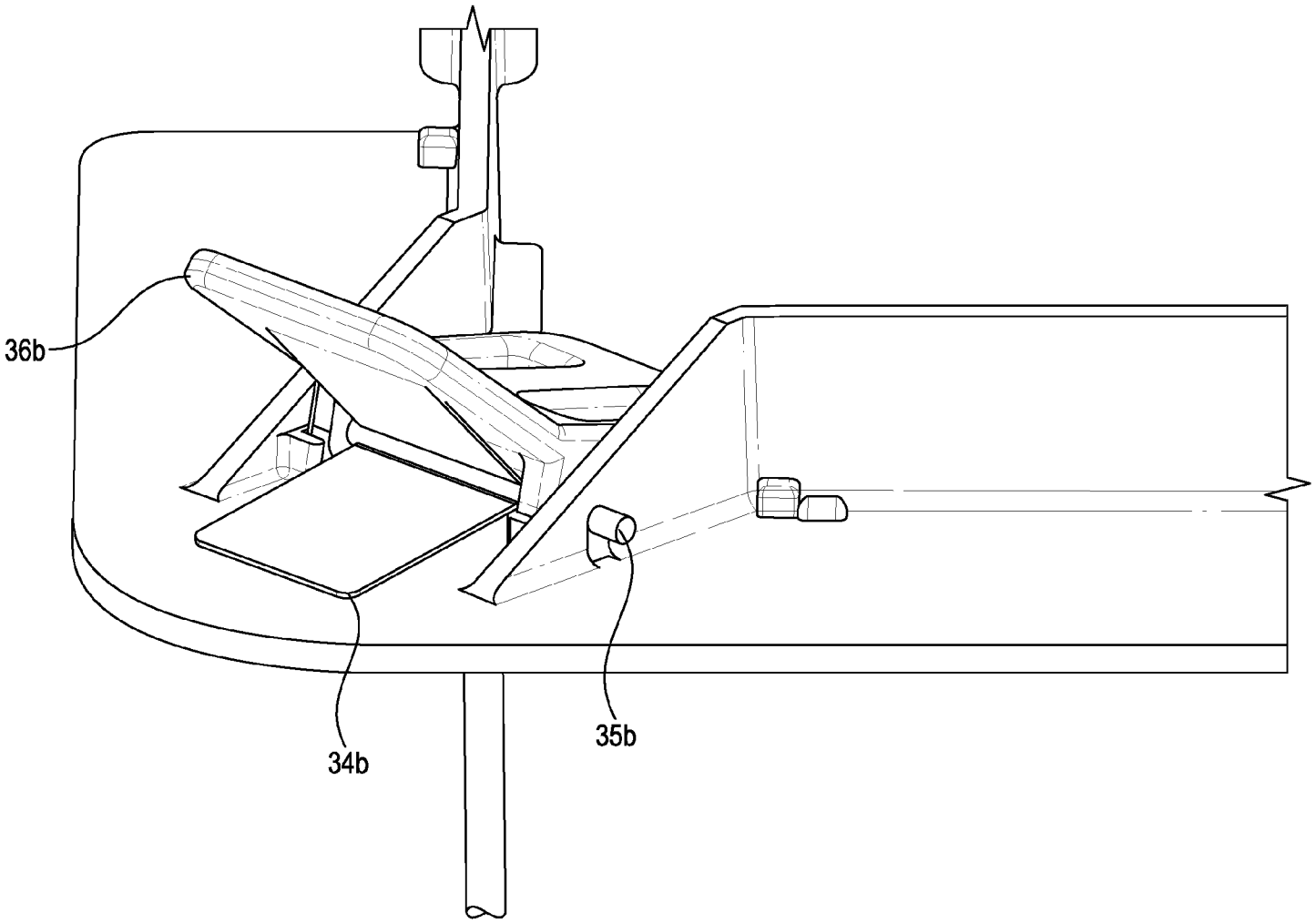
FIG. 9 is a rear view of the apparatus of FIG. 7.
Figure 10:
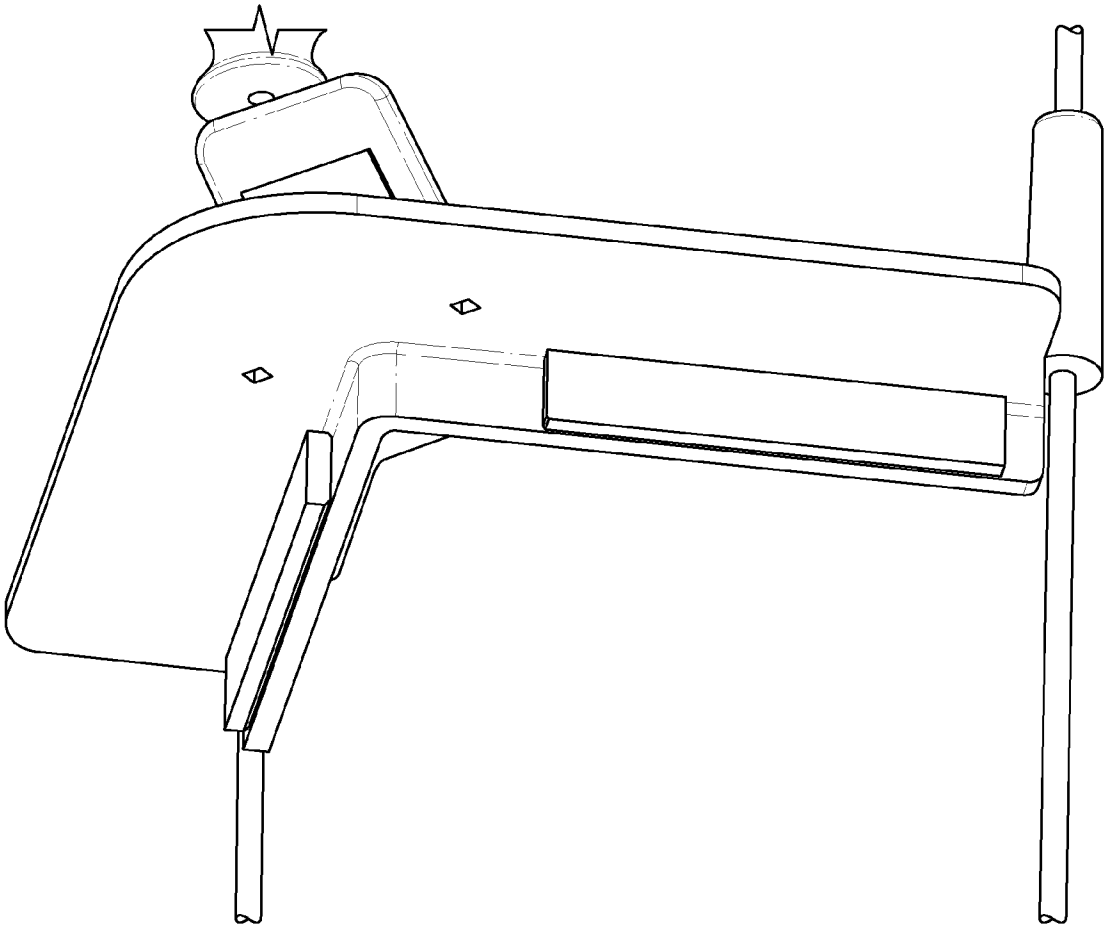
FIG. 10 is a bottom view of the apparatus of FIG. 7.
Figure 11:
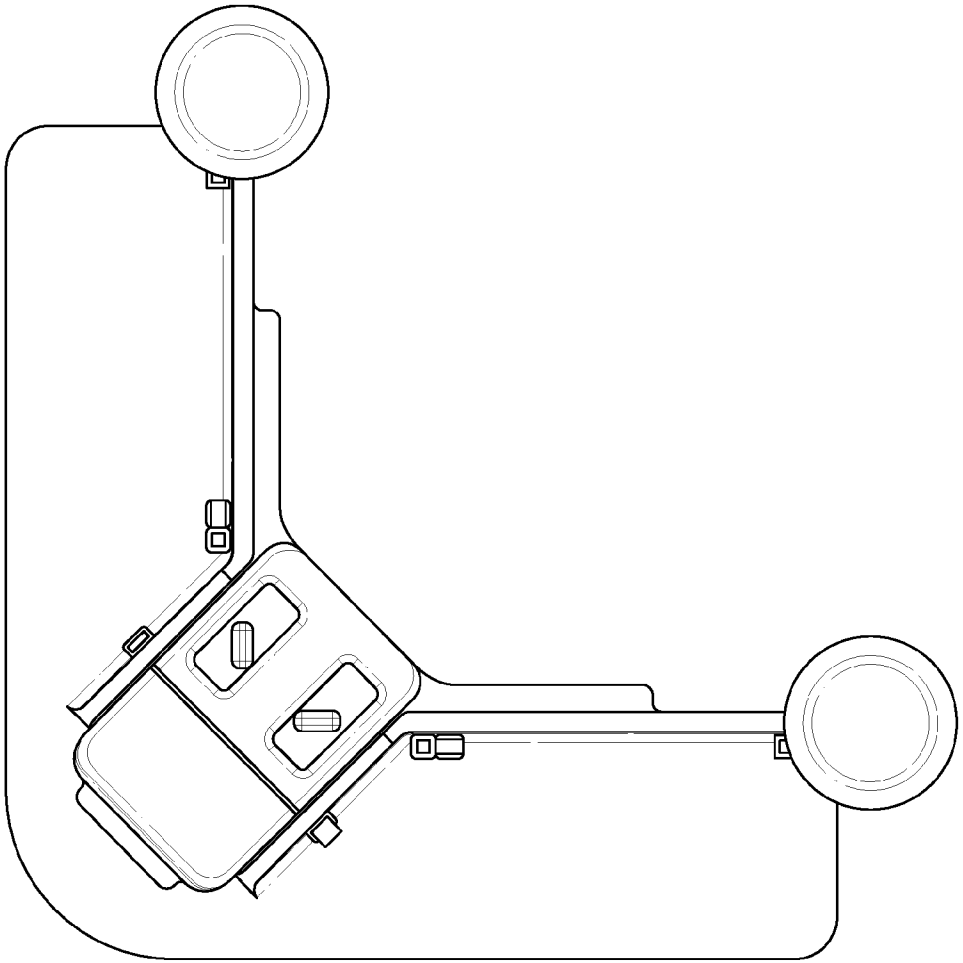
FIG. 11 is a top view of the apparatus of FIG. 7.

The jig member 30A also comprises and one or more spring clamps 32A for retaining the tracing sheets 10 therein. The one or more transparent tracing sheets are configured for receipt within the one or more spring clamps 32A. It should be noted that the jig member may have a different configuration by using a single spring clamp as shown in FIG. 7. In one embodiment, there is one or more spring clamps located in the upper left and lower right corners. These spring clamps are spring activated or biased and when pressed will open and when released will provide a tight grip against a transparent tracing sheet securing it firmly in place. In one embodiment, the spring clamps are integrally formed or attached to the jig member.

In one embodiment, the jig member has a vertical spacer which the cylinder mounts are attached thereto. This vertical spacer is attached to the horizontal top plate which extends one inch and sits on top of the tile or brick. Alternatively, the vertical spacer may slidably engage the horizontal top plate. This spacer secures the jig against the side of the adjacent brick or tile and will not allow the jig to slide off its 90 degree seating position. The vertical spacer extends ¼ inch below the horizontal top plate. The standard width of the vertical spacer is ⅛ inch which allows a minimum mortar or grout joint. However, larger spaces can be added for wider joints. These add on spacers plug into two holes in the standard vertical spacer on each side of the jig. Two spacer holes are defined on one side of the jig member. In addition, the jig member may have an add-on spacer inserted through the hole in the vertical space plate or attached by other means known in the art.

Referring to FIGS. 7-19, in another embodiment, the measuring apparatus may include a jig member 30B with one spring clamp 32B and two secure pins 20B. Referring to FIG. 7, the jig member 30B has a spring clamp 32B which is configured to receive one or more tracing sheets 10. The spring clamp 32B, in one embodiment, comprises a spring member 34B having spring-bias, a top clamp member 36B, and a spring clamp lock 35B for securing the spring clamp 32B to the jig member 30B. In one embodiment, the spring clamp is secured near the intersection of a first leg and a second leg of the jig member which is formed at a 90 degree angle. The spring member provides upward bias against the top clamp member to engage the top clamp member, and its serrated edge, against the surface of the tracing sheets which, in turn, is secured upon the shelf or interior guide 38B of the jig member. The shelf or guide defined as the portion extending from an edge of an interior portion of the jig member along an area, some portion or all, between the cylinder mounts for providing horizontal stability of the tracer sheets therein. The top clamp member also provides one or more apertures on its top surface for providing viewing windows to observe the position of the tracing sheets therein.

Figure 12:
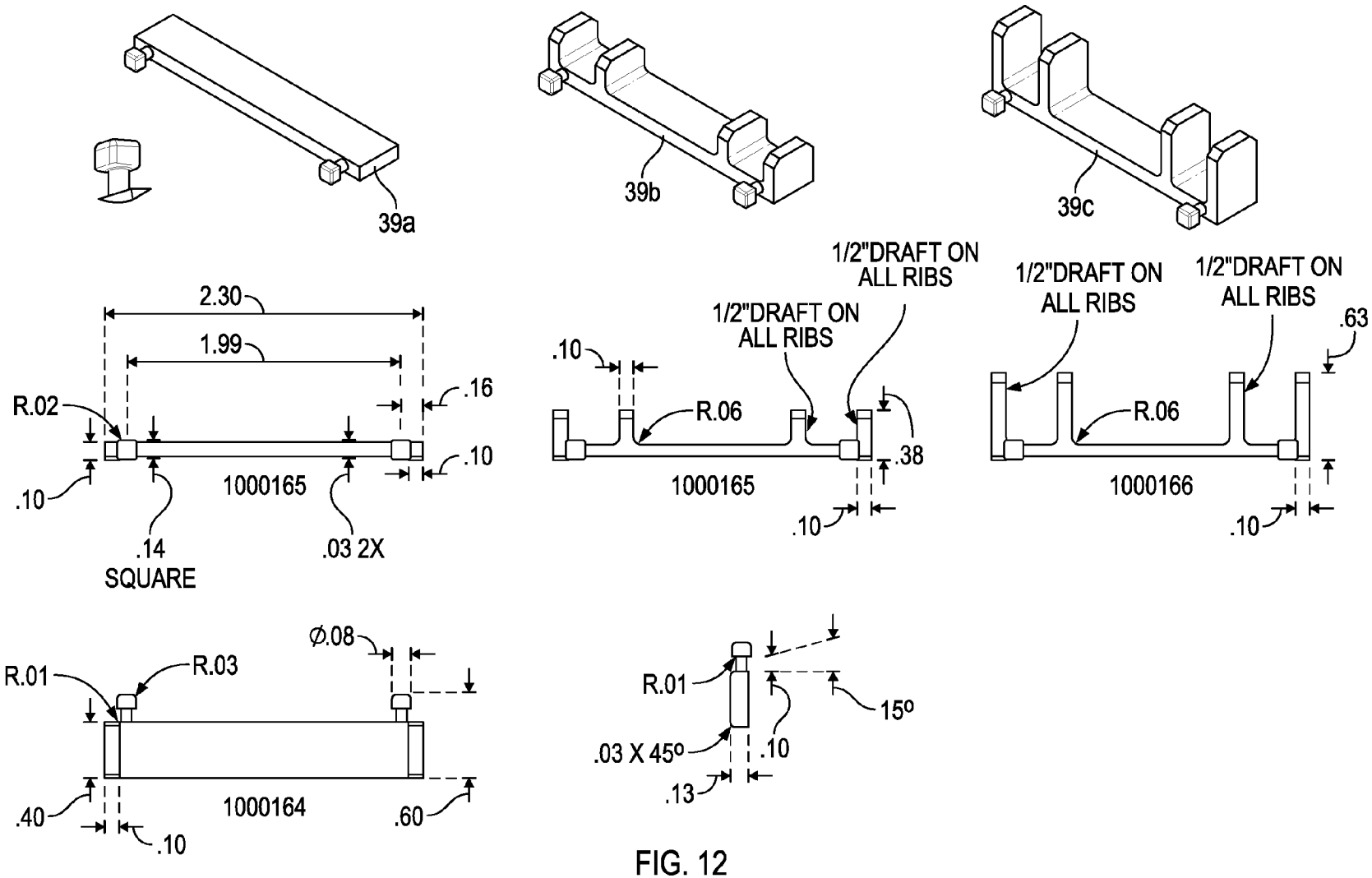
FIG. 12 is perspective view of a spacer configured for use in the apparatus of FIG. 7.
Figure 13:
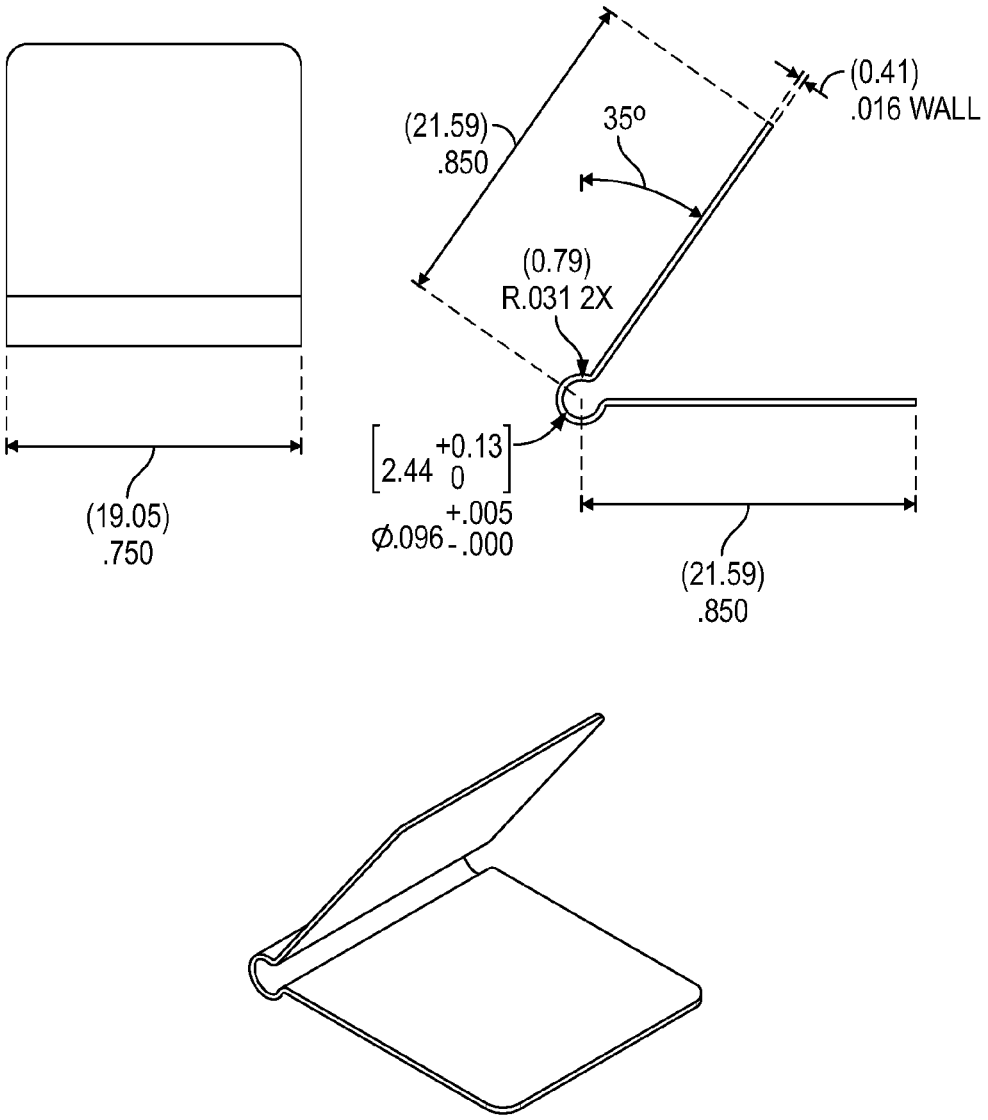
FIG. 13 is perspective view of a spring configured for use in the apparatus of FIG. 7.
Figure 14:
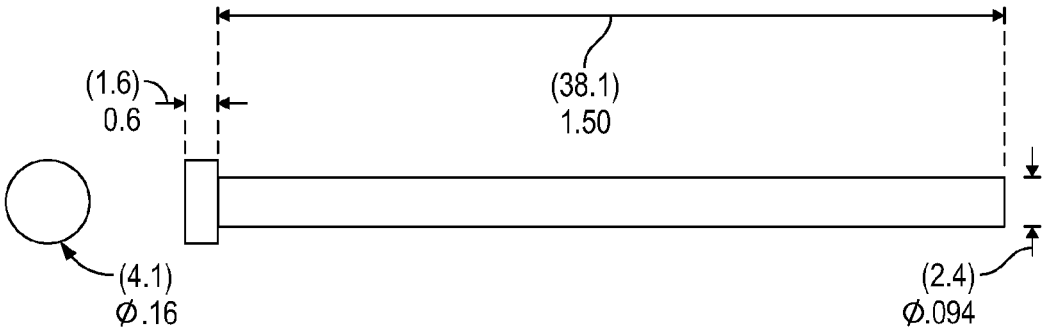
FIG. 14 is side view of a spring retainer configured for use in the apparatus of FIG. 7.
Figure 15:
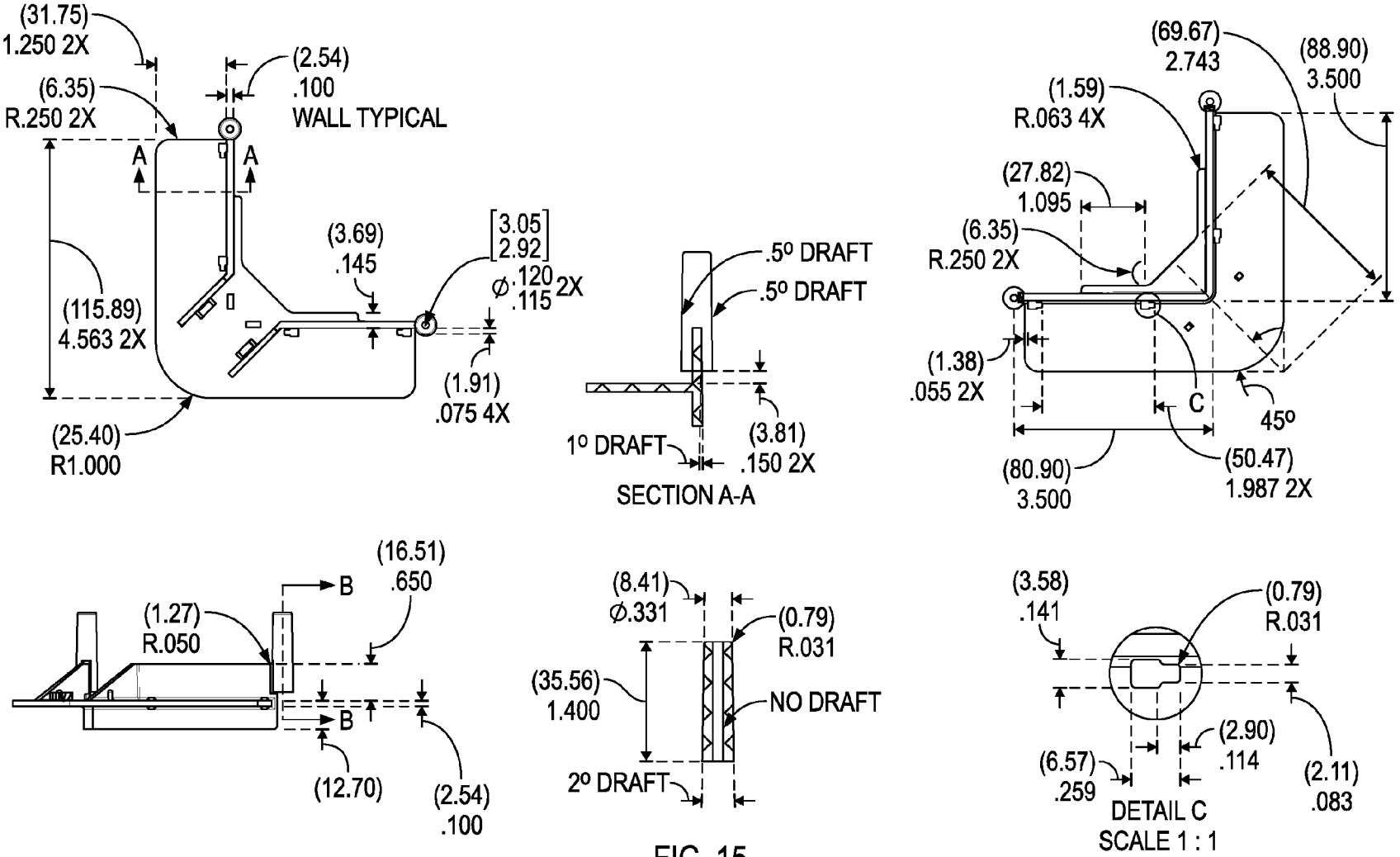
FIGS. 15-16 is a series of views of the jig member for use in the apparatus of FIG. 7.
Figure 16:
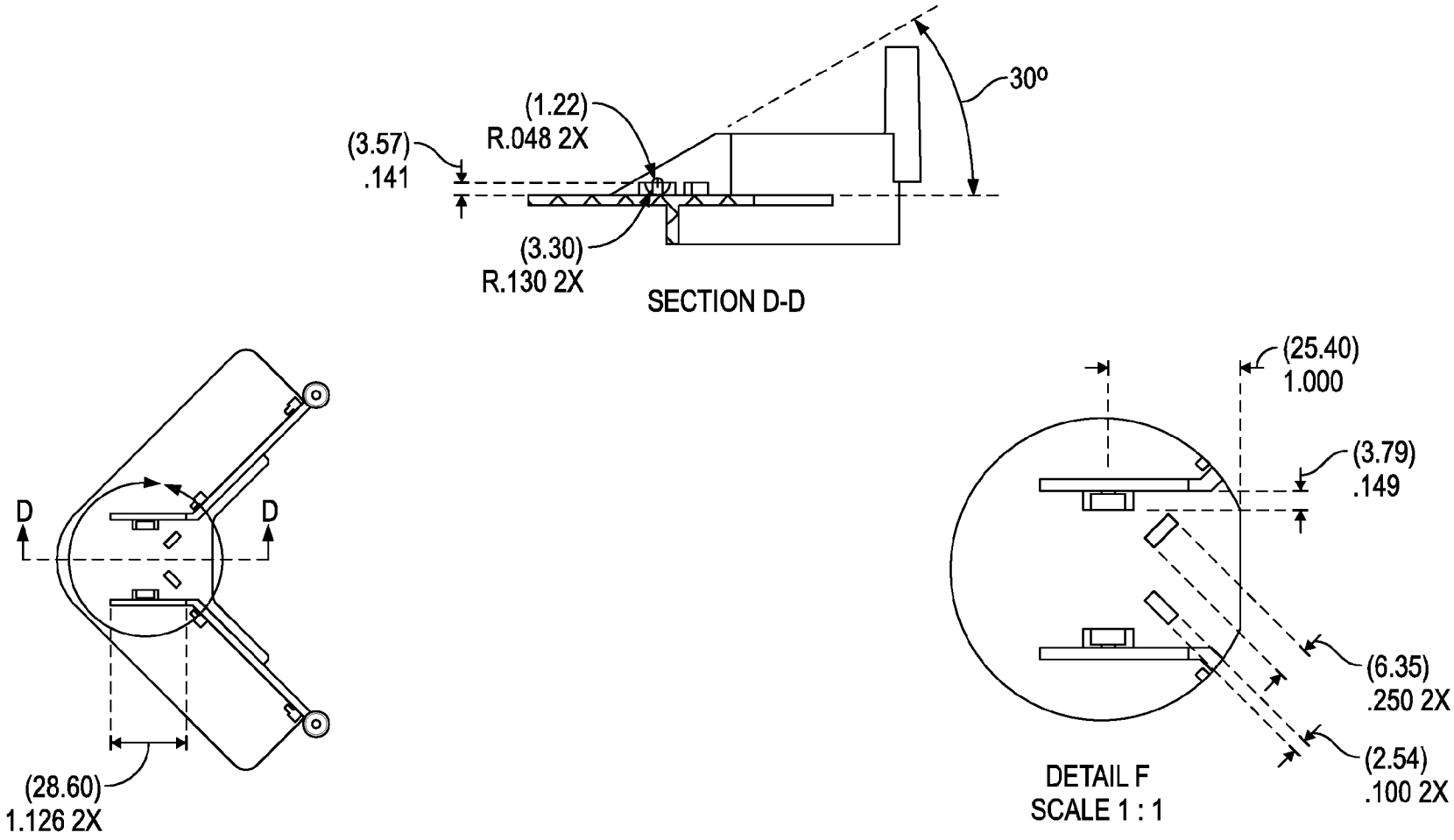
Figure 17:
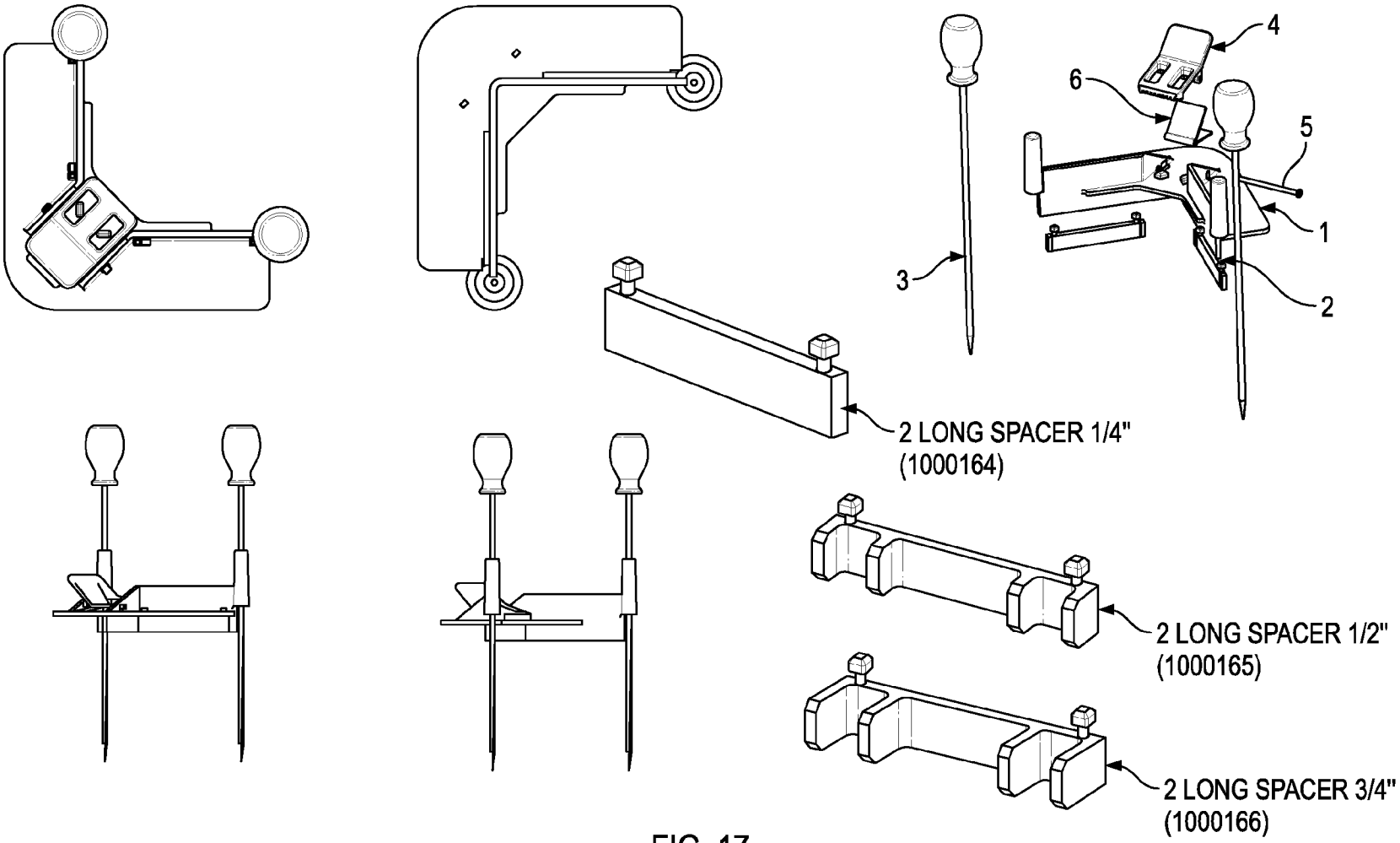
FIG. 17 is a series of views of the jig member using different sized spacers.
Figure 18:
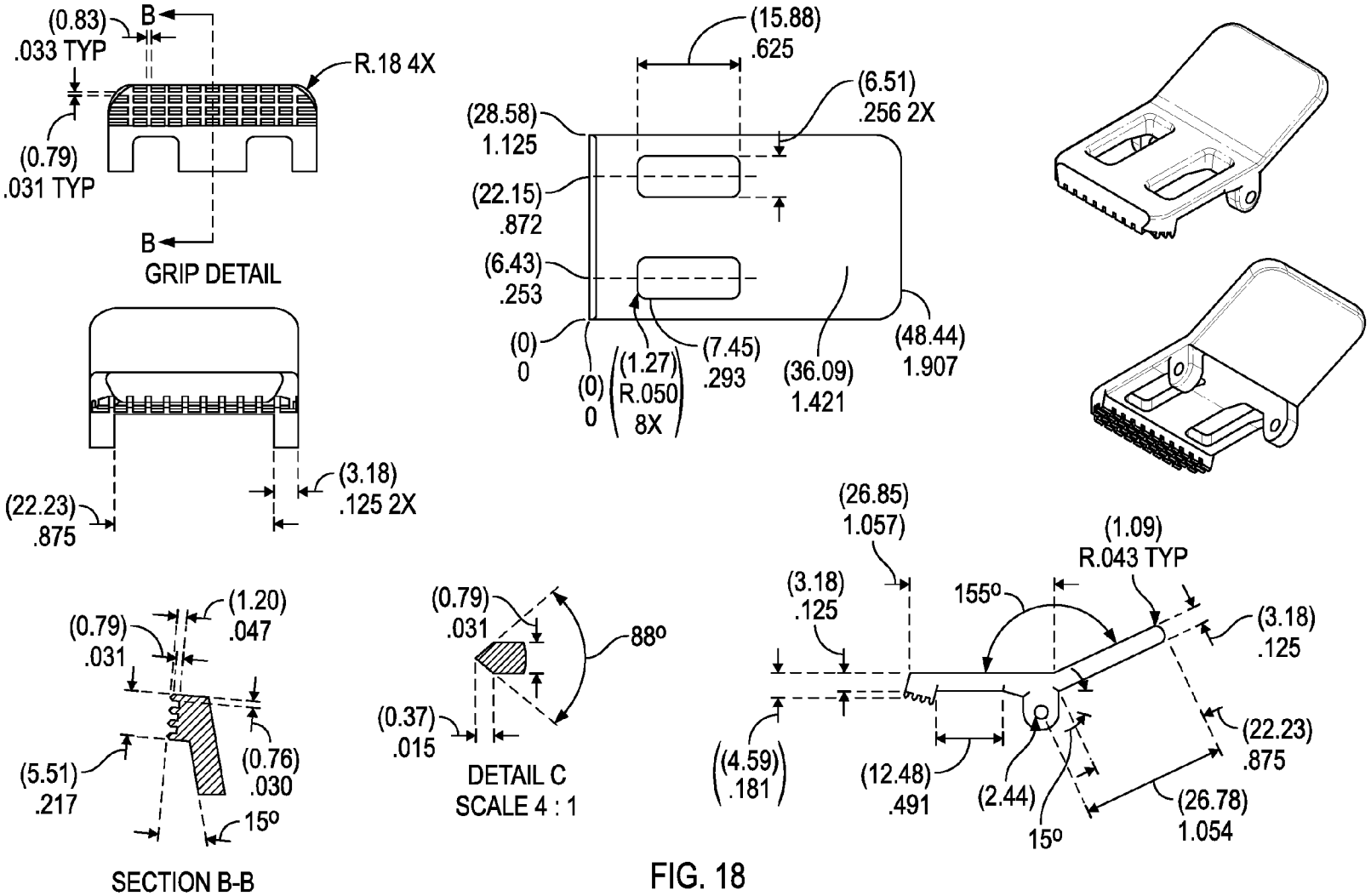
FIG. 18 is a series of views of a spring clamp configured for use in the apparatus of FIG. 7.
Figure 19:
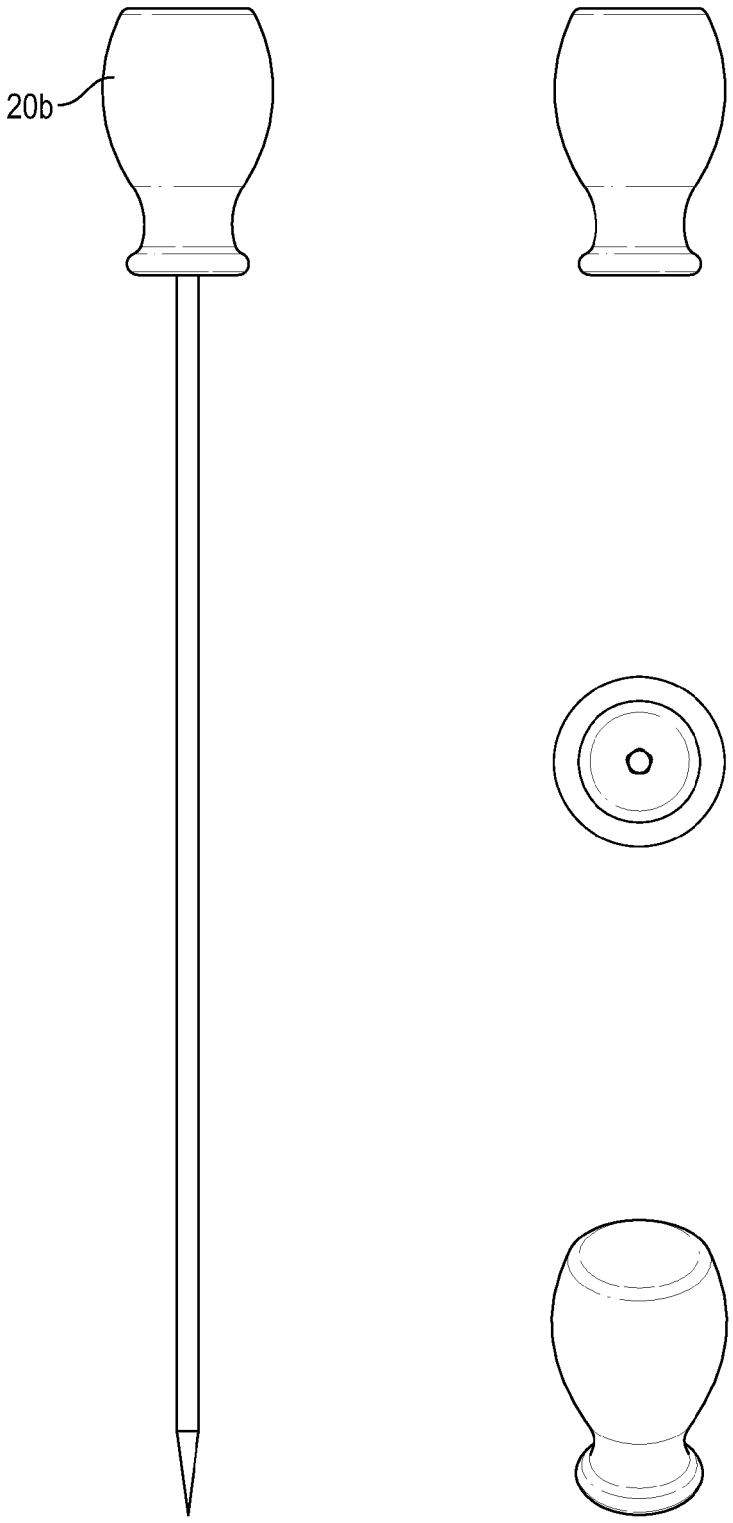
FIG. 19 is series of views of a pin configured for use in the apparatus of FIG. 7.

Referring to FIGS. 12 and 17, the jig member may also include interchangeable vertical spacers 39A, 39B, 39C. In one embodiment, the vertical spacer is attached to one or more legs of the jig member which engage the surface area proximal to the cut area for stability. Alternatively, the vertical spacer may slidably engage the legs of the jig member. This spacer secures the jig member against the side of the adjacent working material or cut area and will not allow the jig member to slide off its 90 degree seating position. In one embodiment, the vertical spacer extends ¼ inch below the one or more legs. The standard width of the vertical spacer is ⅛ inch which allows a minimum mortar or grout joint. However, larger spaces can be added for wider joints such as ½ inch vertical spacers or ¾ inch spacers. These add on spacers removably or permanently attach or plug into apertures or receiving holes on each leg of the jig. In one embodiment, two spacer holes are defined on one side of the jig member. In addition, the jig member may have an add-on spacer inserted into other areas of the jig member or attached by other means known in the art.

In operation, the pins and jig member engage proximal to a cut area to facilitate marking an outline of the cut area on the tracing sheets which are subsequently cut and used in measuring and cutting of the working material. For example, a measuring apparatus comprising one or more transparent tracing sheets, one or more pins, and/or a jig member is provided. The measuring apparatus is engaged proximal to a cut area to be measured. The one or more transparent tracing sheets are marked with a trace line outlining the cut area to use in measuring and cutting of the working material. Next, the one or more transparent tracing sheets are cut along the trace line to provide the tracing sheet in the shape of the cut area. The working material is marked with a cut line outlining the tracing sheet in the shape of the cut area. The working material is cut along the cut line to provide the material in the shape of the cut area.

In use, the jig member, secure pins, and tracing sheets are used to facilitate the cutting of a material, such as tile as illustrated in the many examples listed below.

Figure 23:
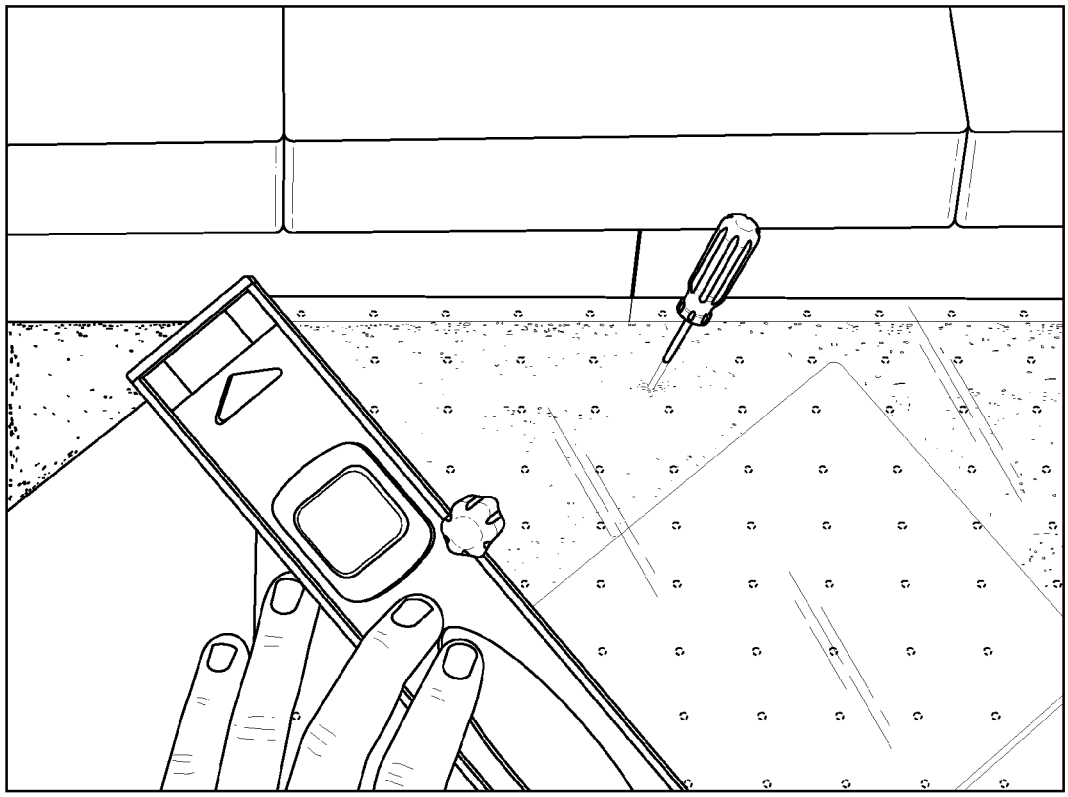
Figure 24:
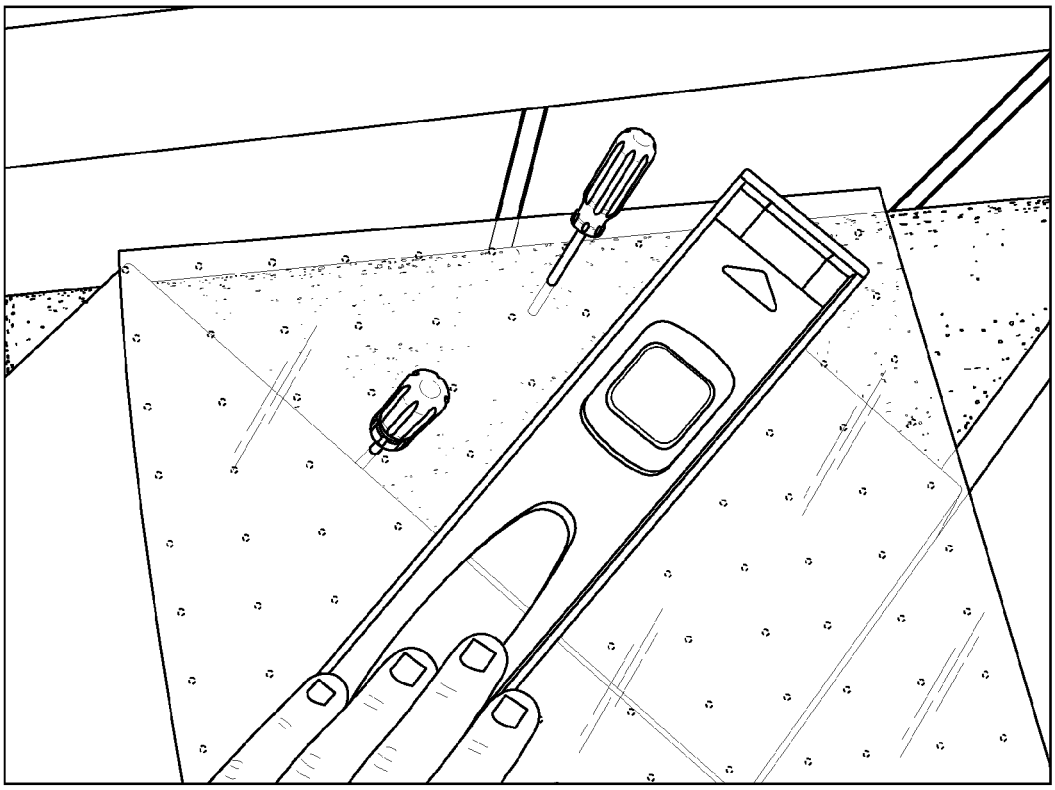
Figure 25:
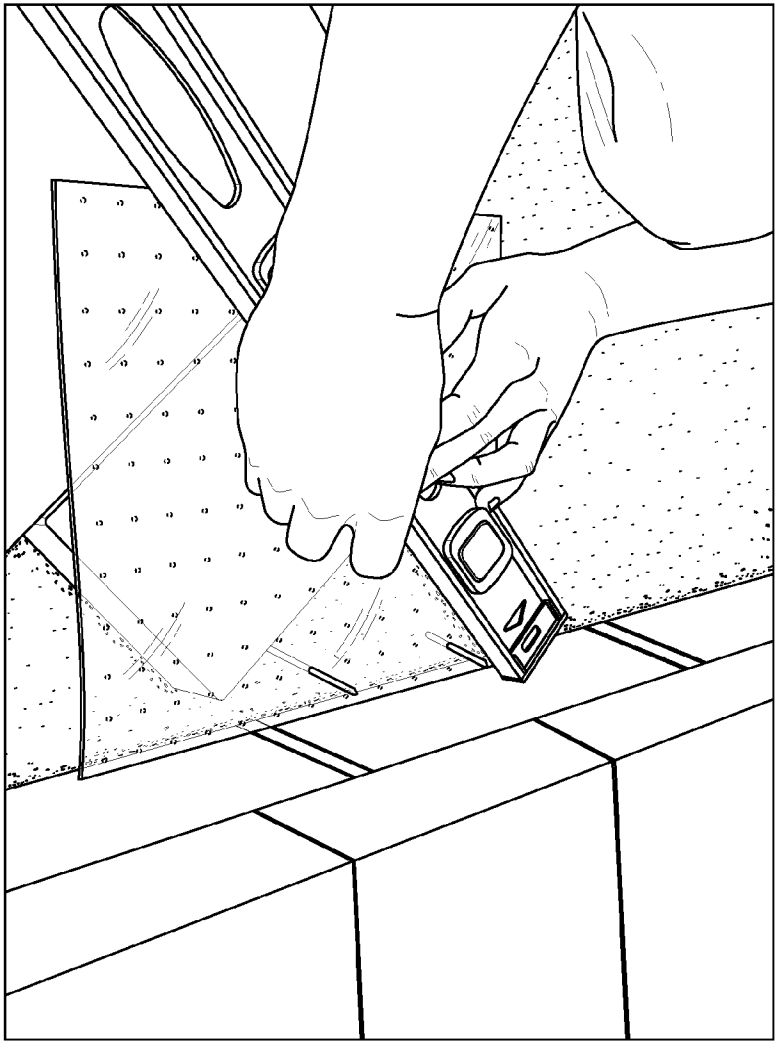
Figure 26:
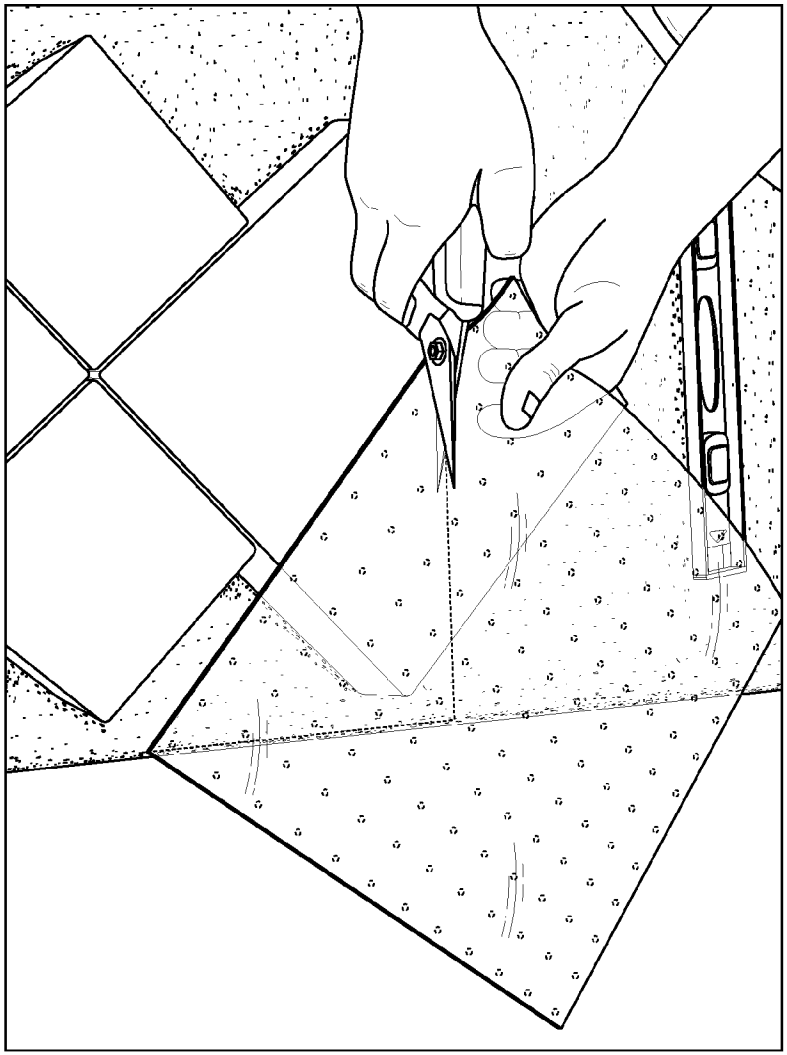
Figure 27:
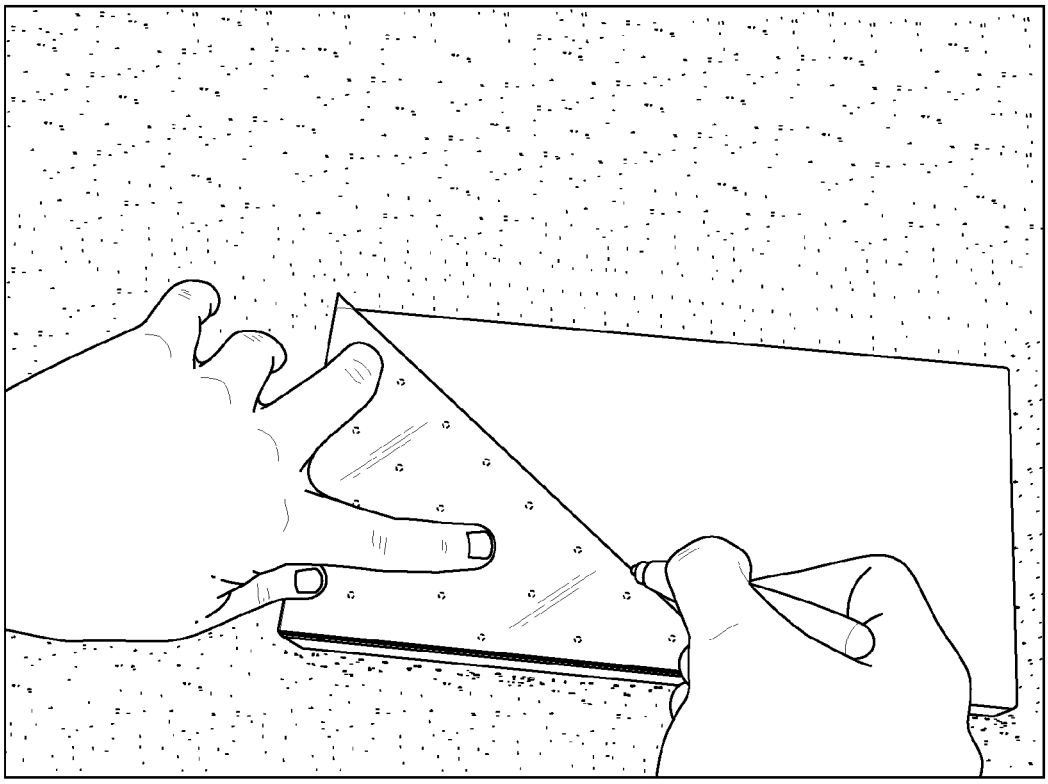
Figure 28:
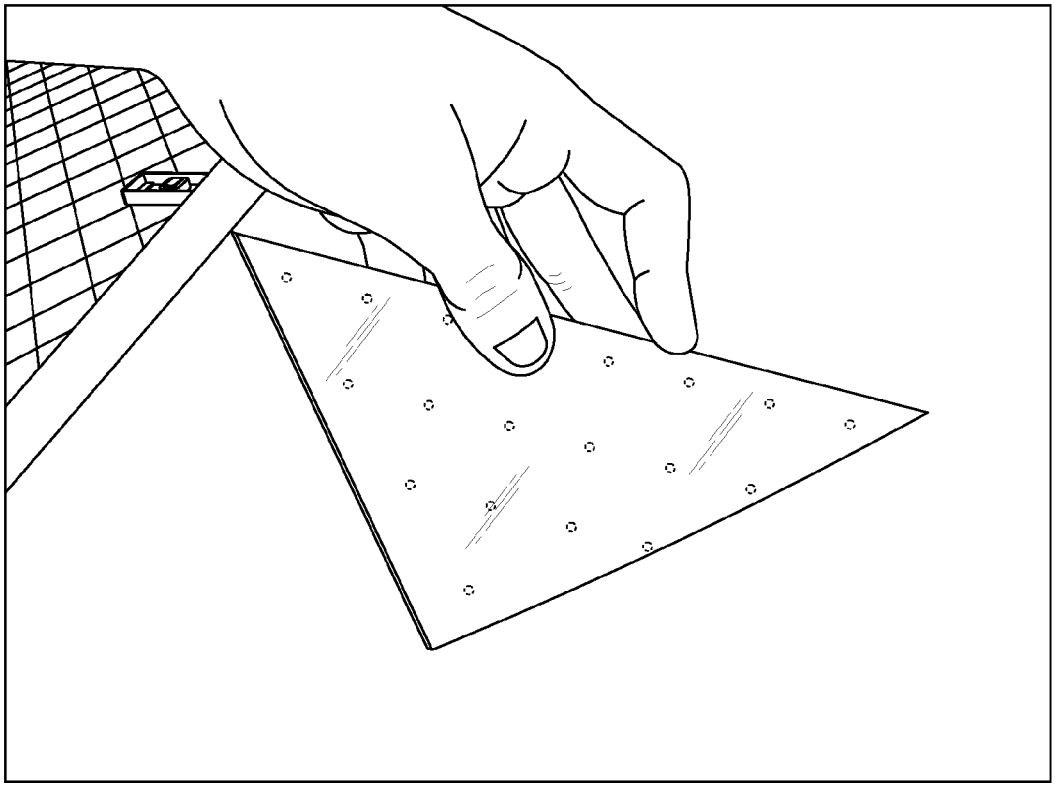
Figure 29:
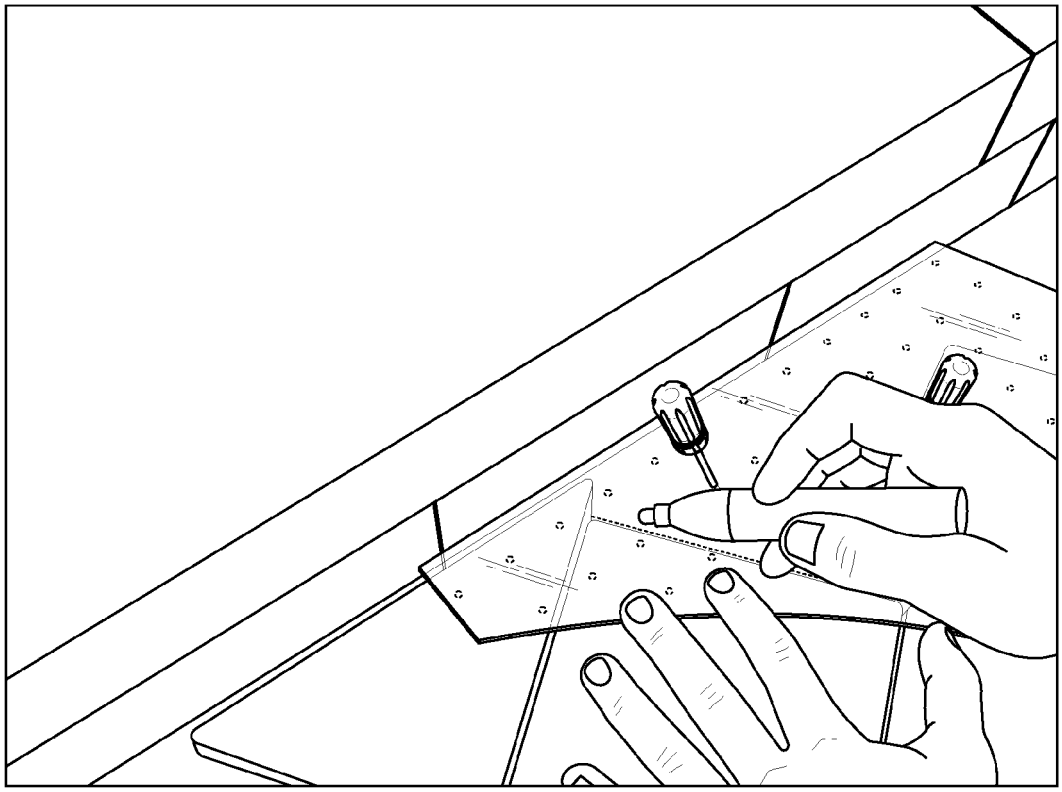
Figure 30:
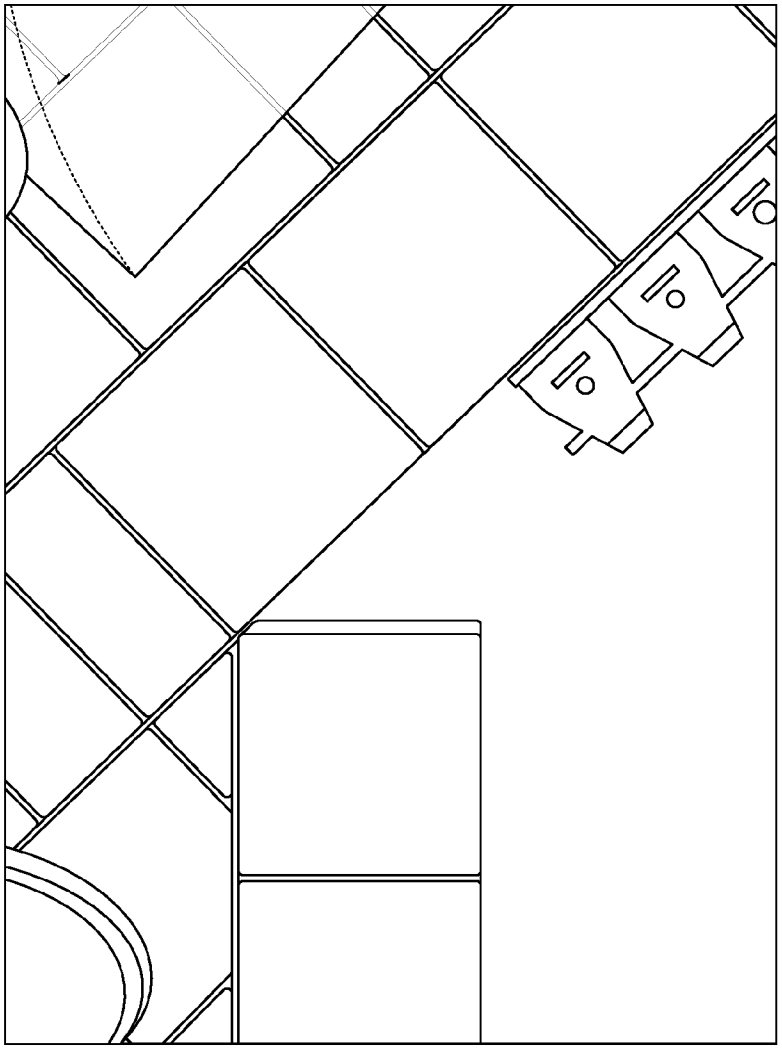

For example, now referring to FIGS. 21-30, the measuring apparatus, system, and method is illustrated on how to use the tracing sheets and pins of the measuring apparatus to facilitate a straight line cut. The tracing sheets and secure pins may be used where the cuts have to be made up against a vertical structure, such as a stair. The jig member may fit, however, the transparent tracing sheet will not so, in this embodiment, the secure pins may be used without the jig member. In this example, referring to FIG. 22, the transparent tracing sheet is placed flush up against the stairs. The secure pins are tapped down through the holes or receiving area in the tracing sheet into the gravel or the floor board depending if the job is tile or brick. Referring to FIG. 23, a level is used as a straight edge to trace the outline of the cut area with a marker. Referring to FIG. 24, one side is marked and the other side is lined up and marked. Referring to FIG. 25, the outline is marked using a level as a straight edge. Referring to FIG. 26, the outline is cut out to form a template. Referring to FIG. 27, the template is placed on a new brick and the angle is drawn. Note, the original 90 degree angled corners of the new brick have been substituted for the first two drawn angles. The new drawn line is the part of the trace sheet flush against the stairs. Referring to FIG. 28, the brick or working material is cut and put in place. Referring to FIG. 29, after the cut piece has been put in place, the second cut is being traced using a scrap piece of tracing sheet.

Figure 31:
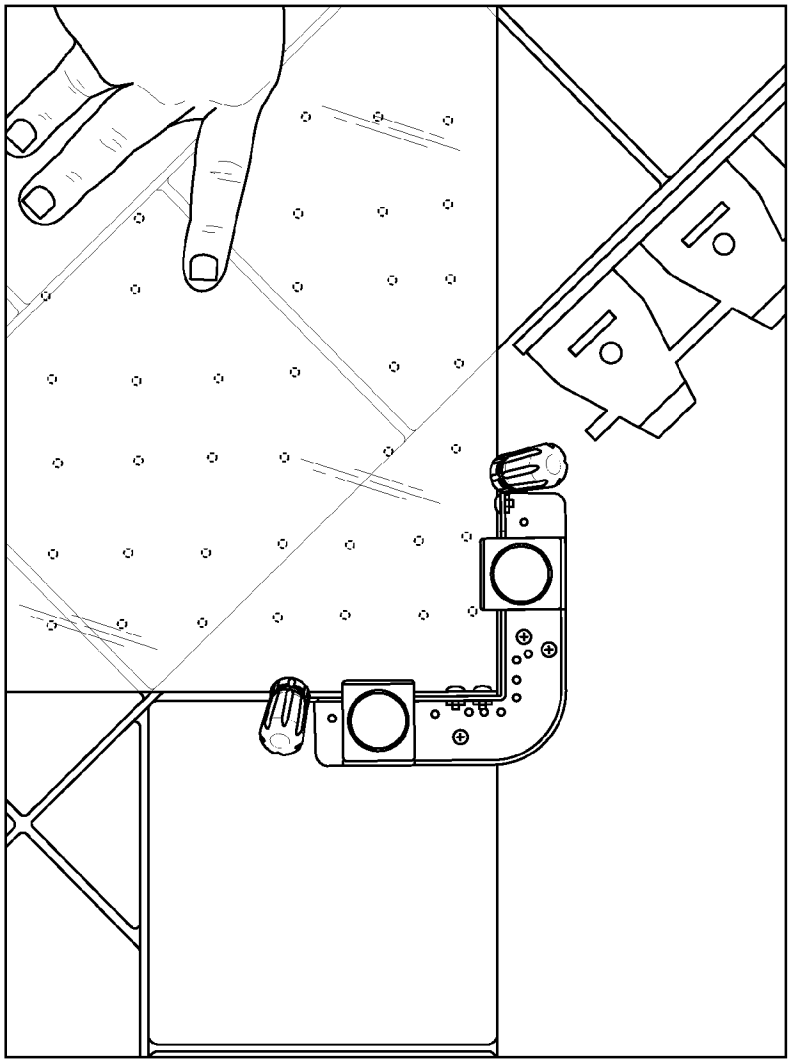
FIGS. 31-33 illustrate how to use the jig member with the pins and tracing sheets of the apparatus to facilitate an angle cut.
Figure 32:
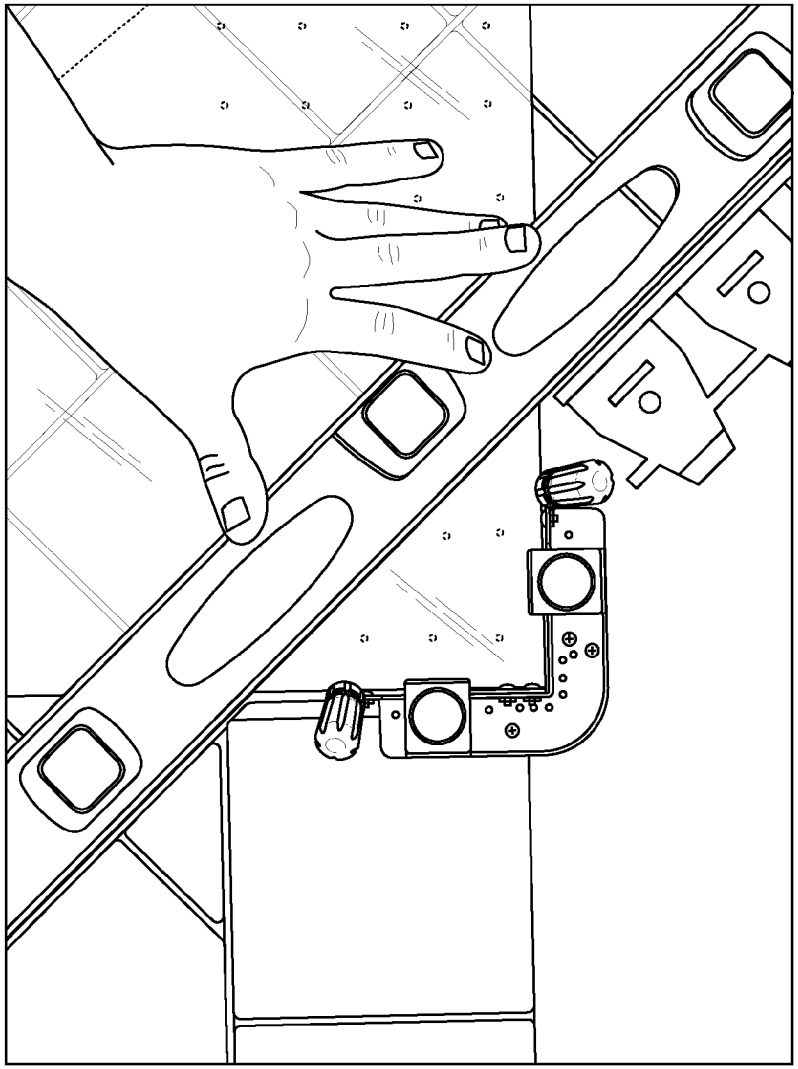
Figure 33:
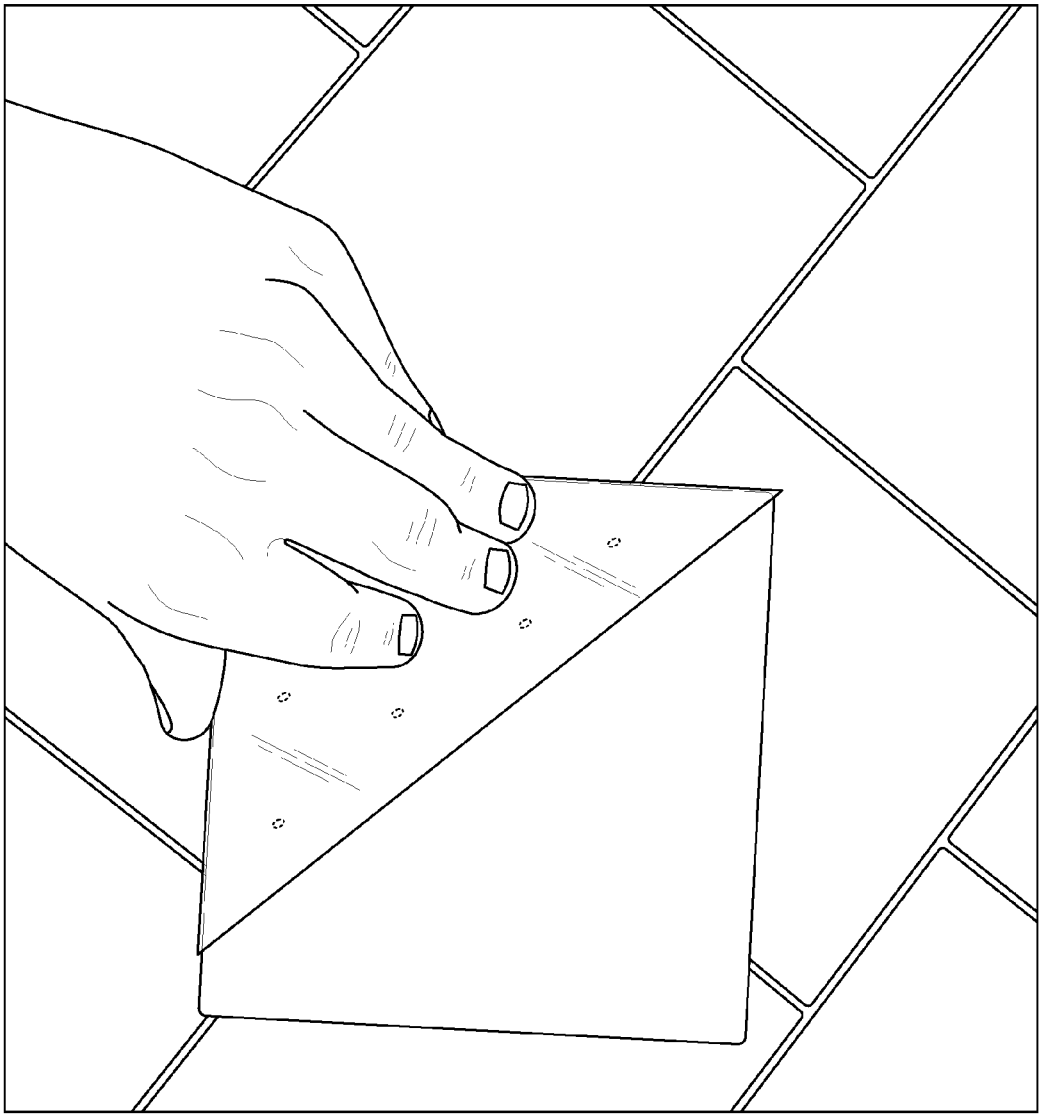
Figure 34:
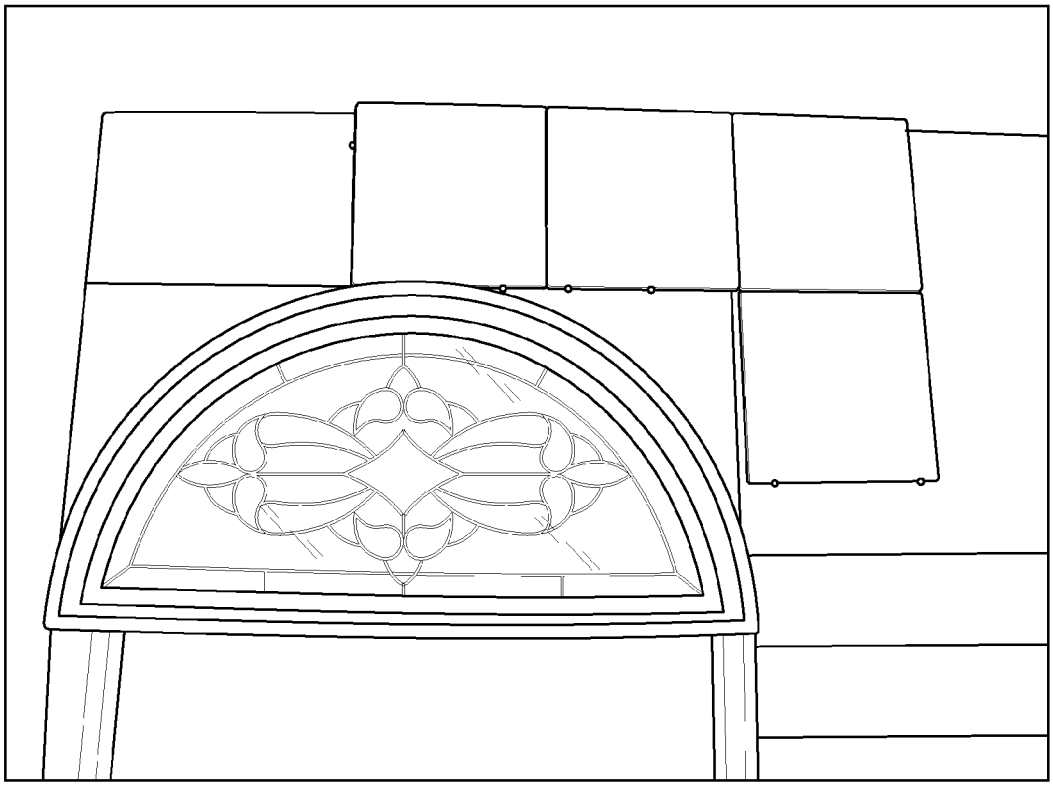
FIGS. 34-43 illustrate how to use the jig member with the pins and tracing sheets to facilitate a radius cut.

For example, now referring to FIGS. 31-33, the measuring apparatus, system, and method is illustrated on how to use the jig member with the pins and tracing sheets of the apparatus to facilitate an angle cut. Another example is shown of how to use the jig member and tracing sheets to provide an angle cut in working material, such as brick or tile. Referring to FIG. 31, the jig member is set to the 90 degree angle of the adjacent brick or tile and is secured in place by tapping the secure pins into the floor or gravel. The transparent tracing sheet is then placed into the one or more spring clamps. Referring to FIG. 32, a straight edge is used instead of free hand to outline the angle cut and is marked on the trace sheet with a marker. Referring to FIG. 33, after the trace sheet has been cut it is lined up at all angles on top of a new brick and the angle is drawn with a marker.

Figure 35:
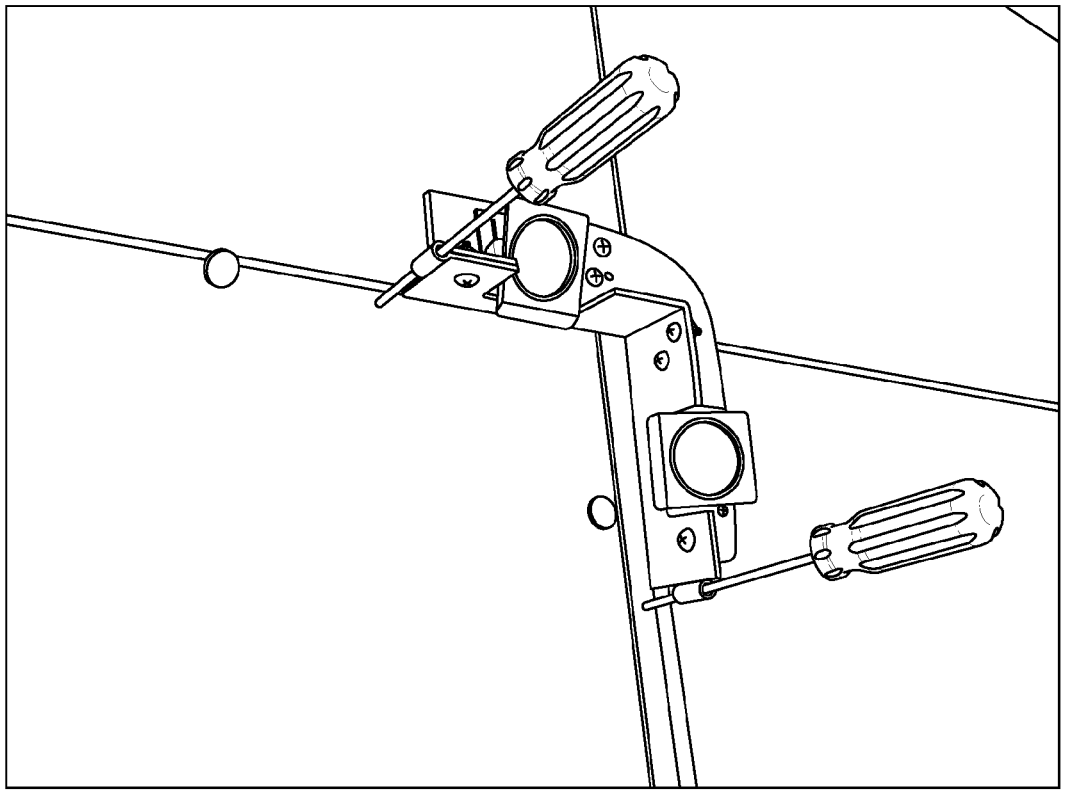
Figure 36:
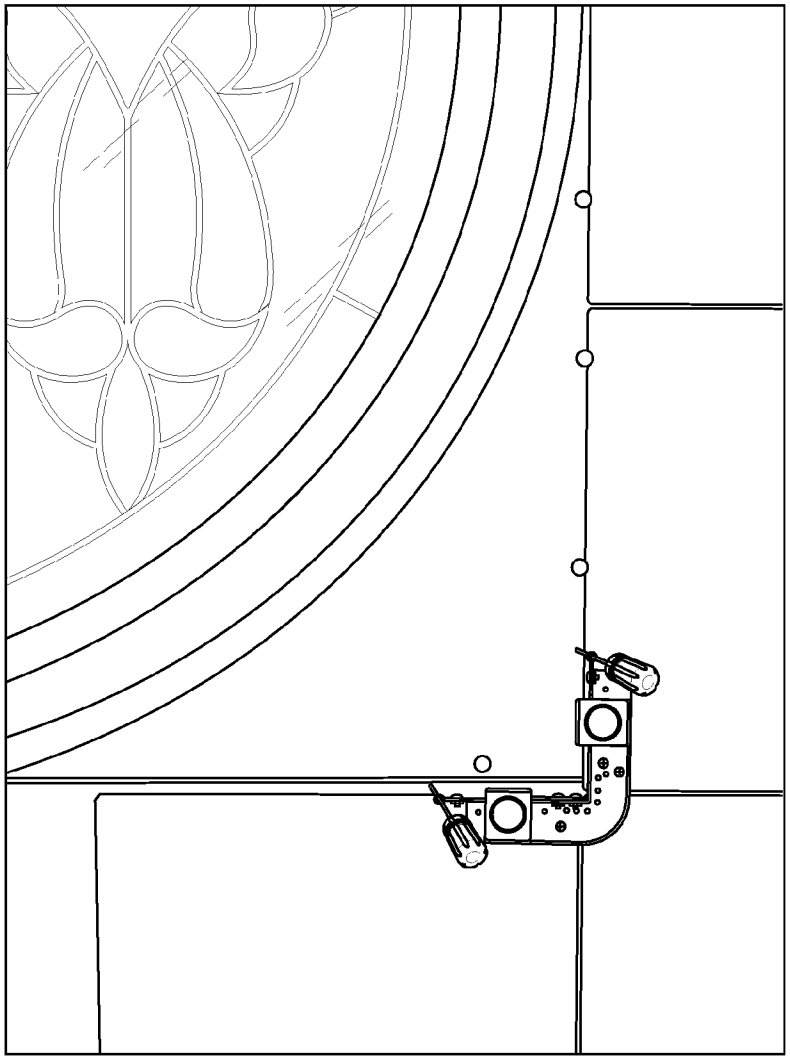
Figure 37:
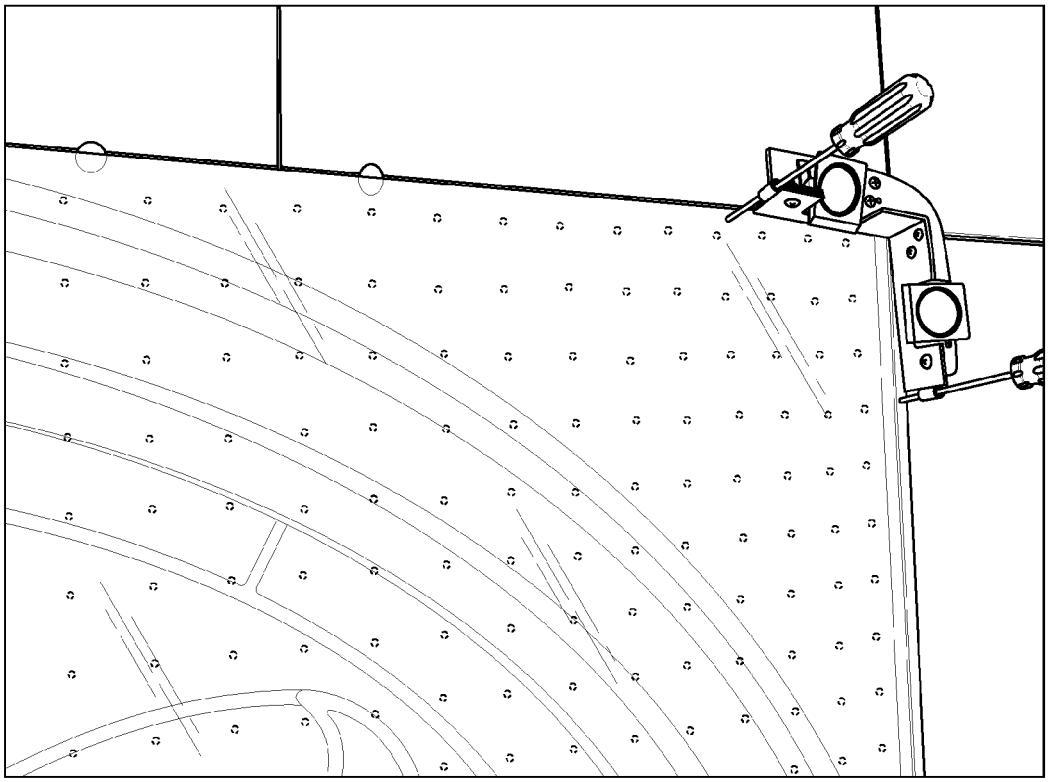
Figure 38:
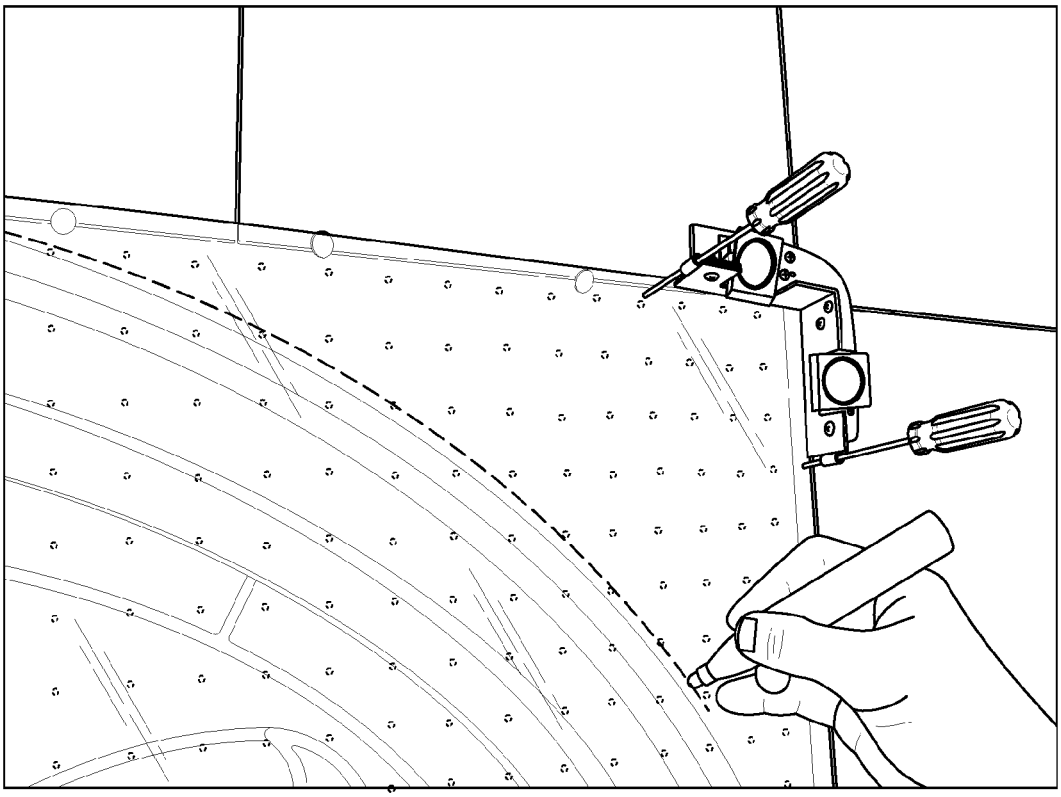
Figure 39:
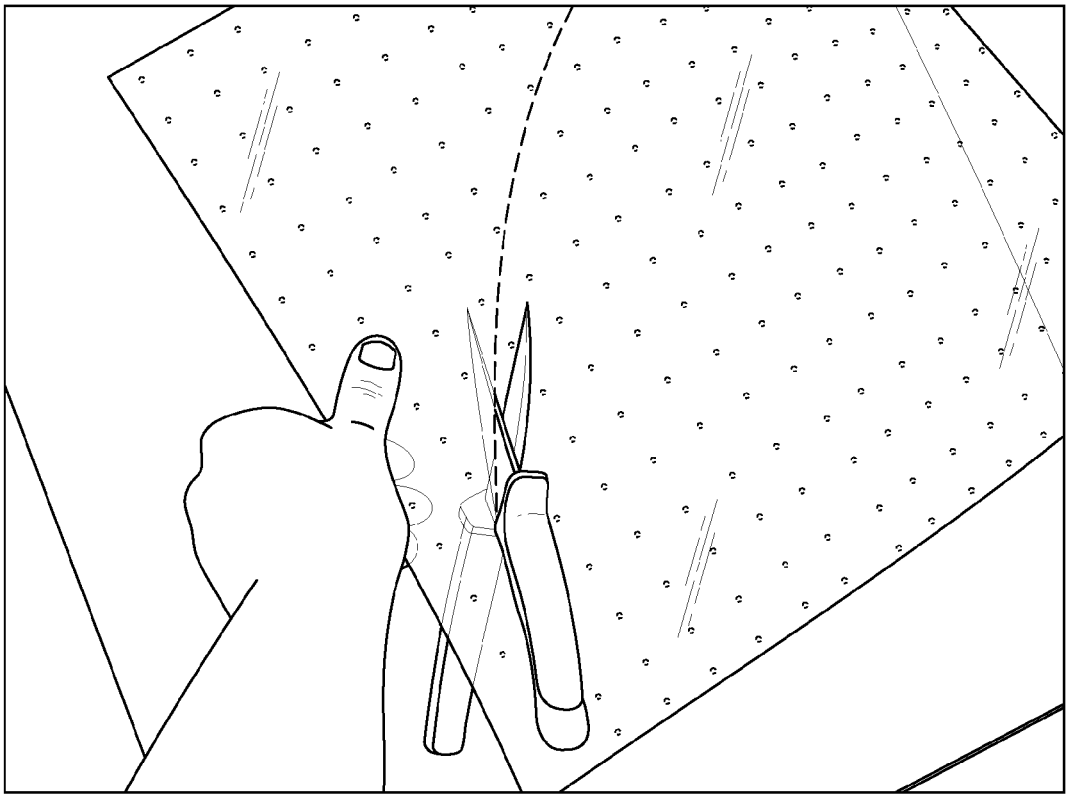
Figure 40:
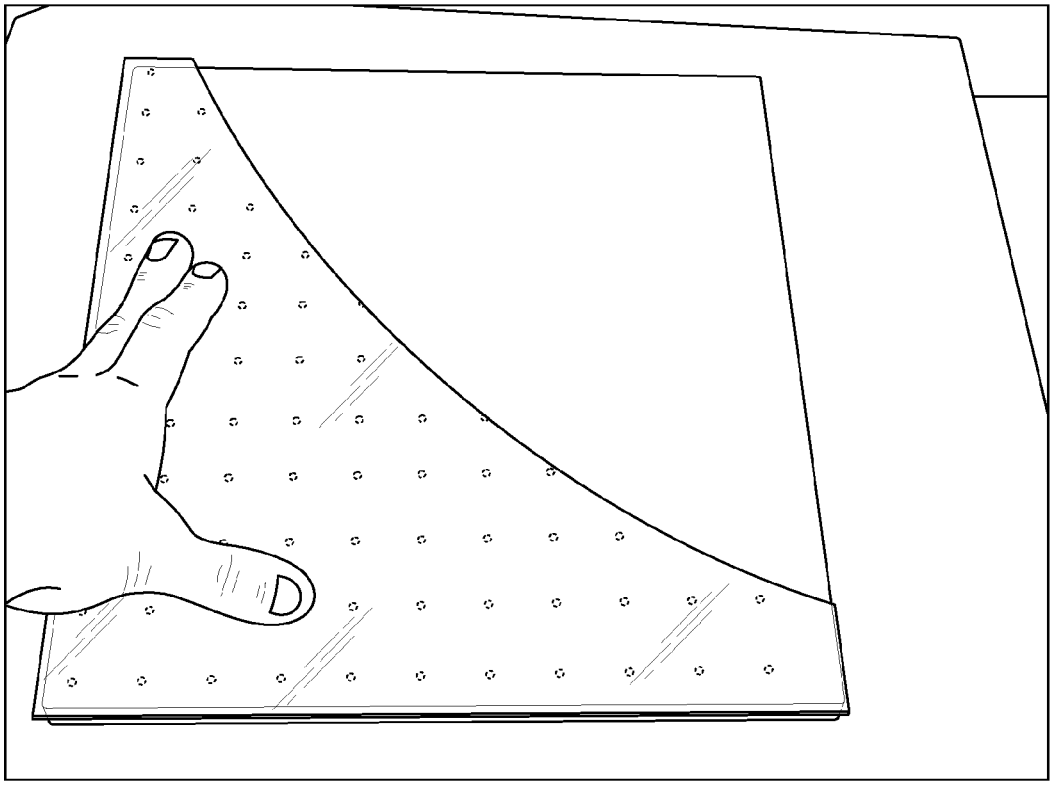
Figure 41:
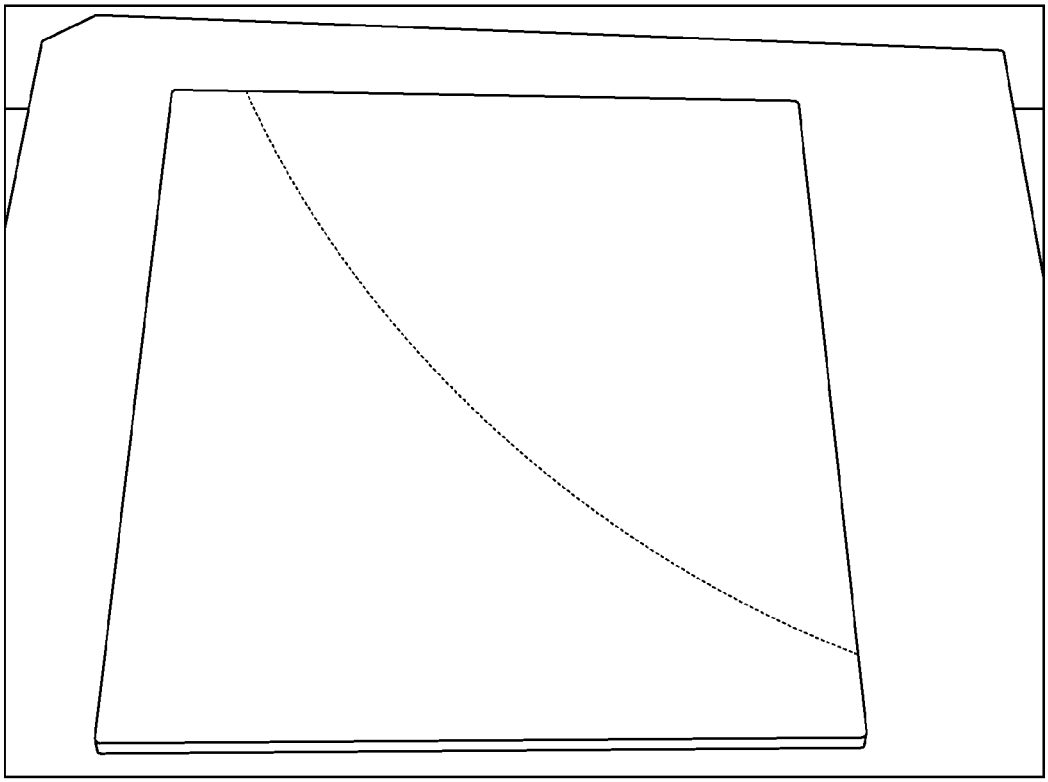
Figure 42:
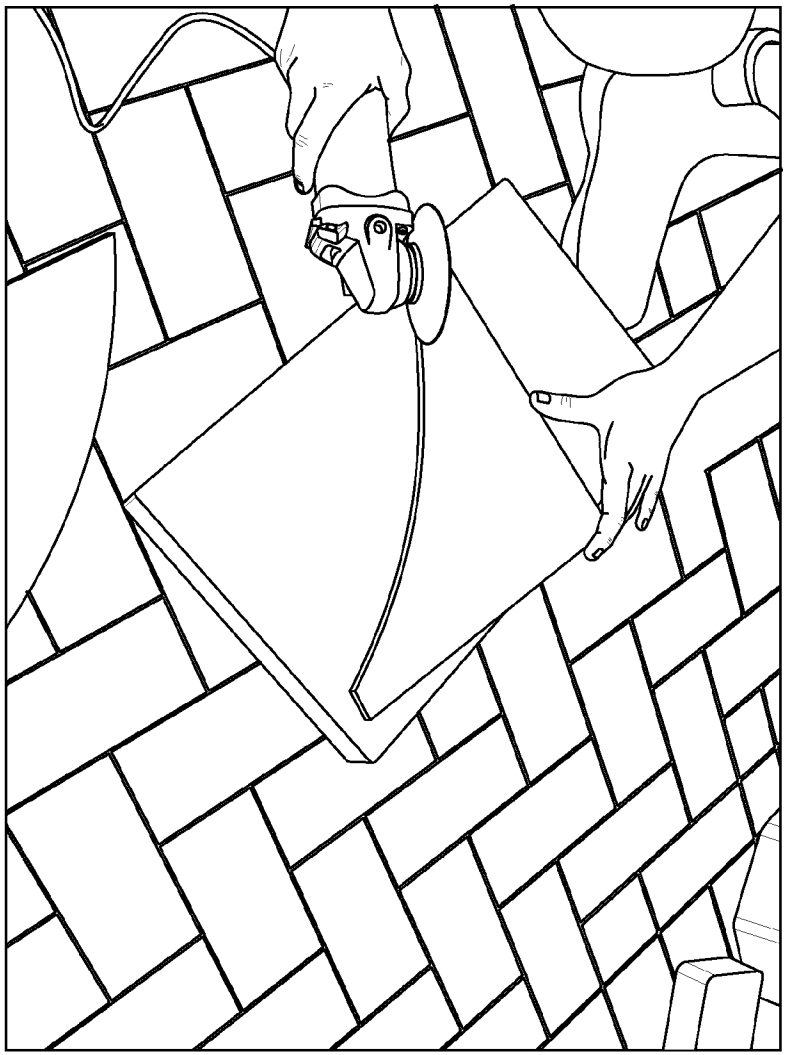
Figure 43:
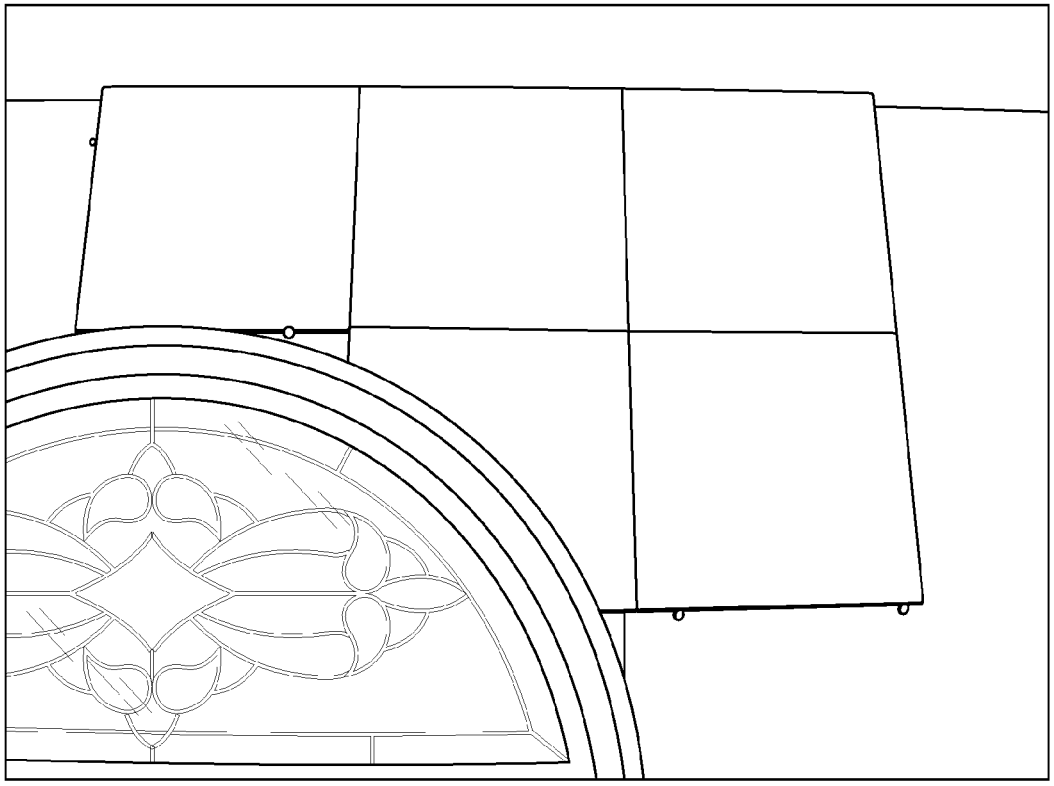
Figure 44:
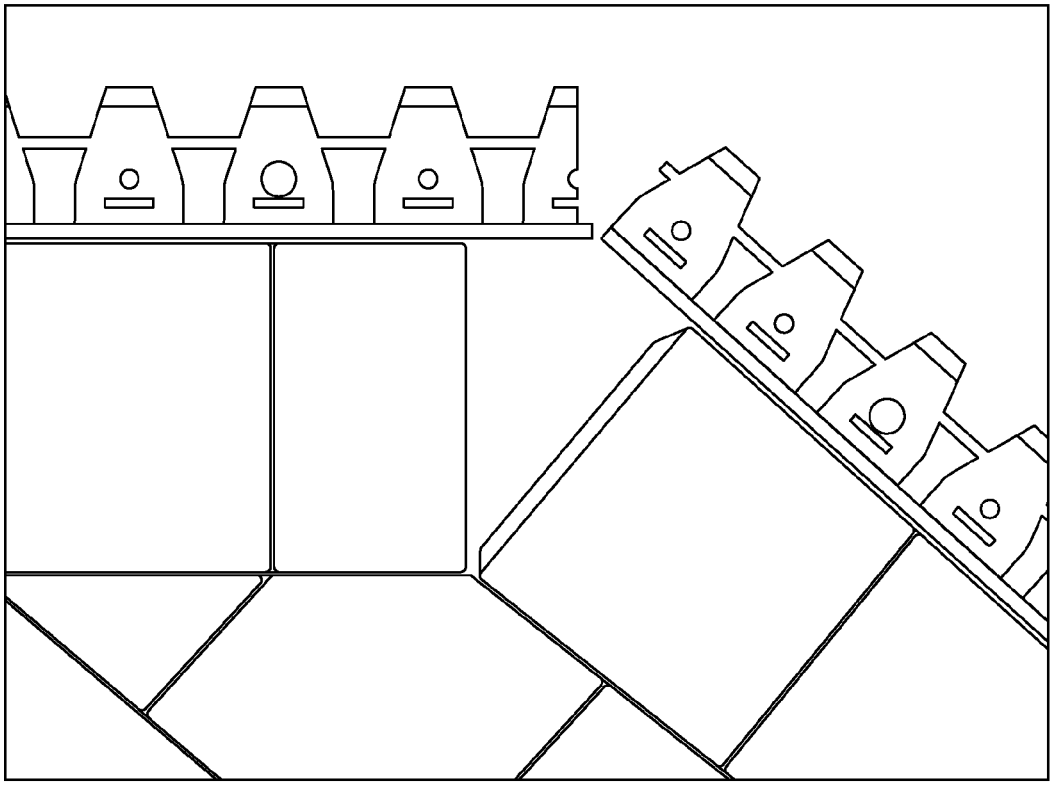
FIGS. 44-51 illustrate how to use the jig member with the pins and tracing sheets to facilitate an irregular cut.

For example, now referring to FIGS. 34-43, the measuring apparatus, system, and method is illustrated on how to use the jig member with the pins and tracing sheets to facilitate a radius cut. Another example is shown of a how to use the jig member and tracing sheets to make a tile or wall veneer radius cut against a radius window or structure. Referring to FIG. 35, the jig member is positioned to place it securely against the existing set tiles and press or tap the secure pins into the drywall board. Referring to FIG. 36, a wide view is illustrated with the jig member in place. Referring to FIG. 37, the transparent tracing sheet is placed and secured into the two bracing clips or spring clamps. Referring to FIG. 38, a user looks through the transparent tracing sheet to draw the outline of the intended radius cut. In another embodiment, the tracing sheet may also be cut along line A to provide a second template for purposes of separately cutting a second piece of tile. Referring to FIG. 39, after the tracing sheet is removed from the jig, the tracing sheet is carefully cut along the marked outline. Referring to FIG. 40, the cut tracing sheets is then placed on a new tile and lined up on all corners to draw the outline of the radius cut onto the tile. Referring to FIG. 41, the traced radius on the tile is shown prior to cutting the tile. Referring to FIG. 42, the tile is then cut on the radius using a grinder or other cutting tool. Referring to FIG. 43, the new tile is cut and placed into the proper position.

Figure 45:
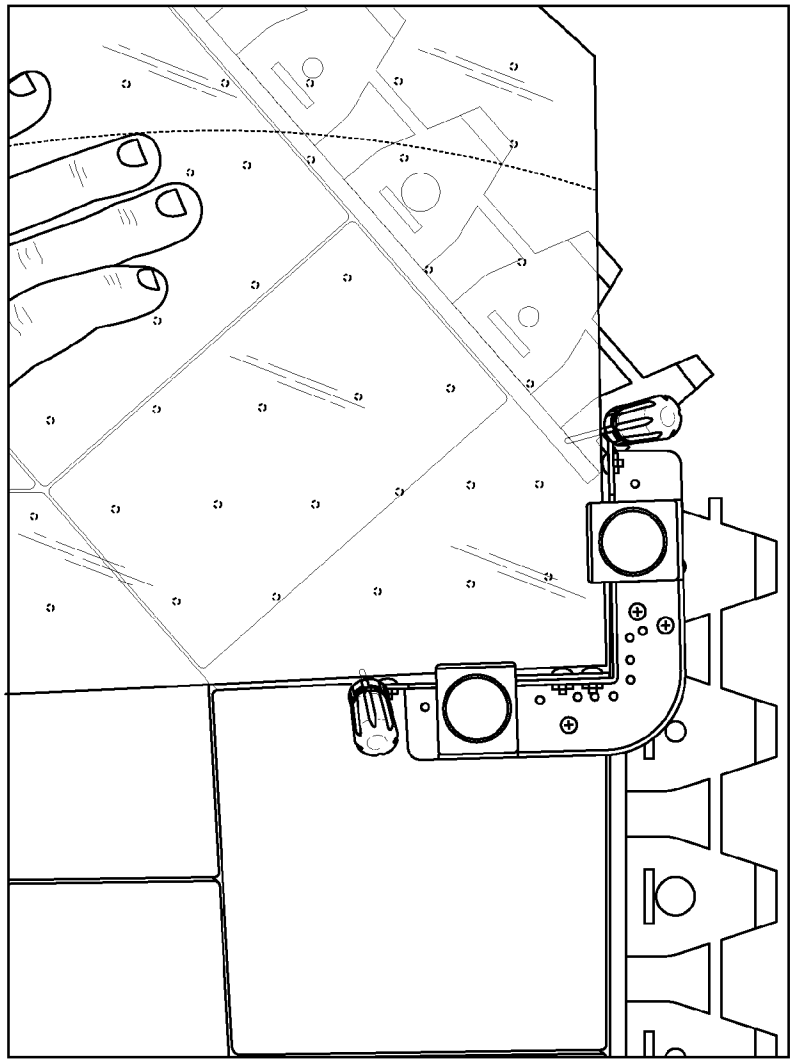
Figure 46:
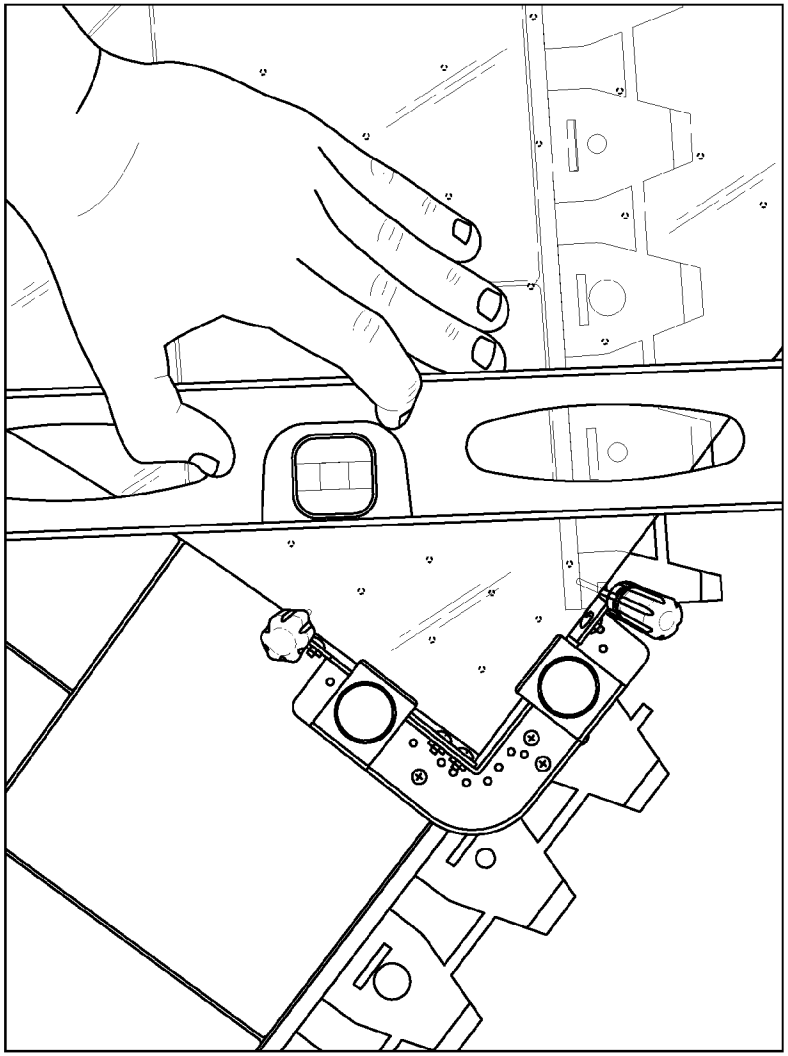
Figure 47:
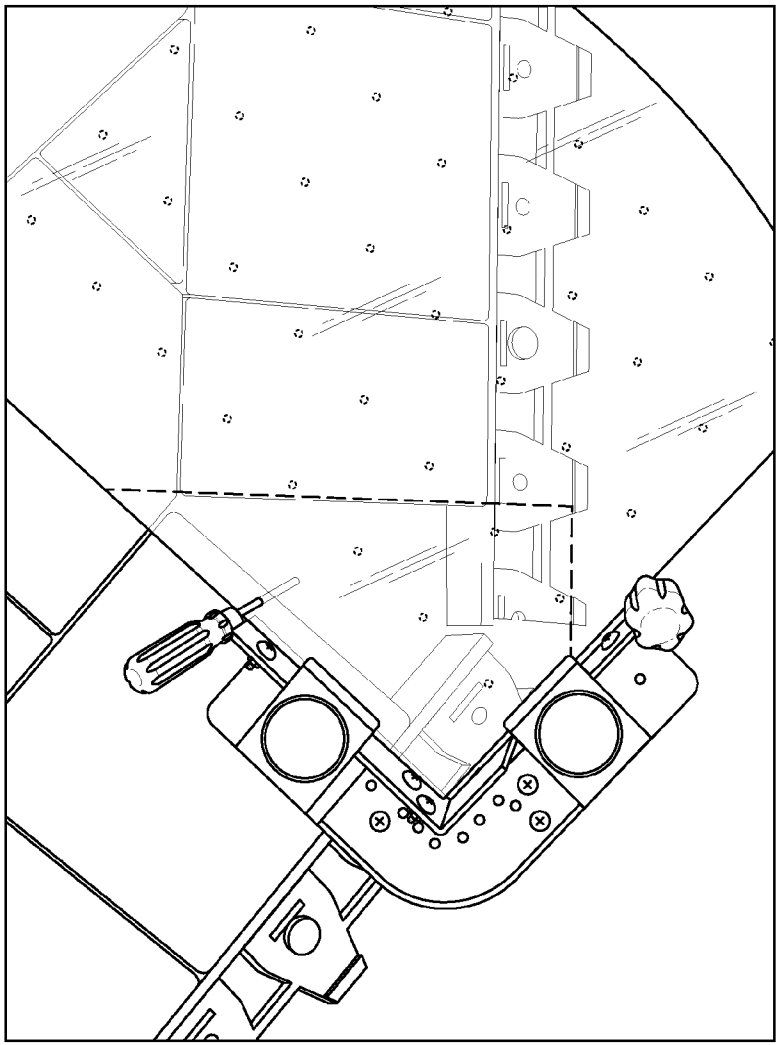
Figure 48:
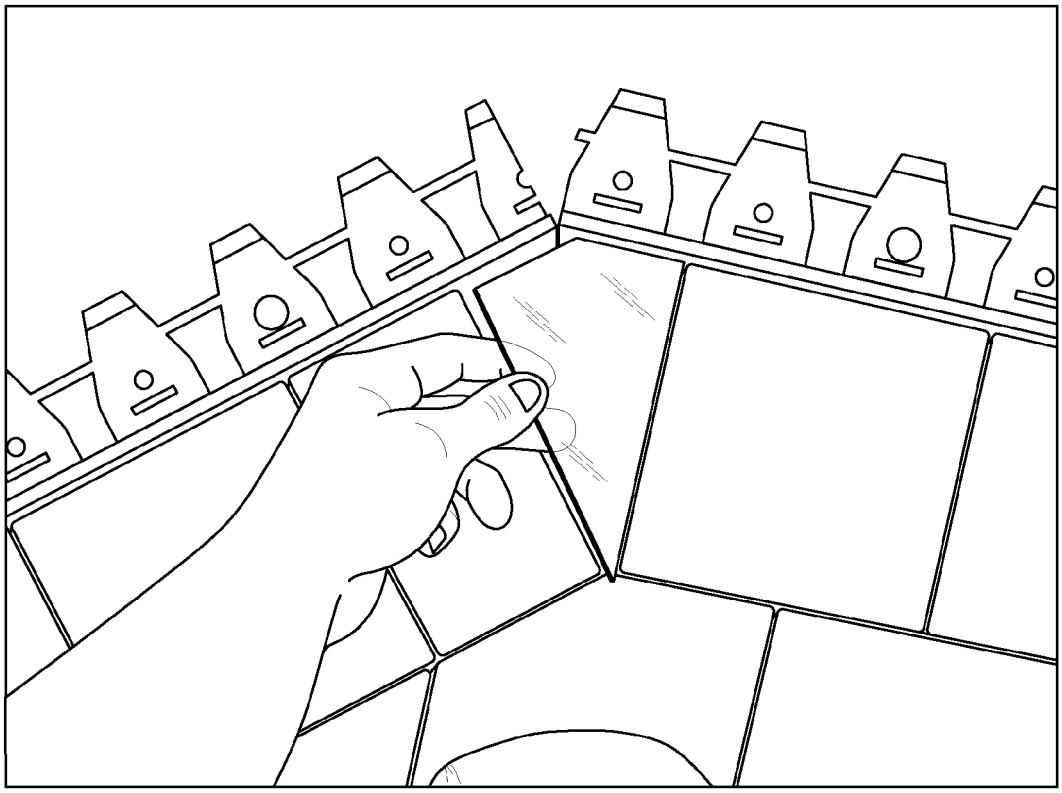
Figure 49:
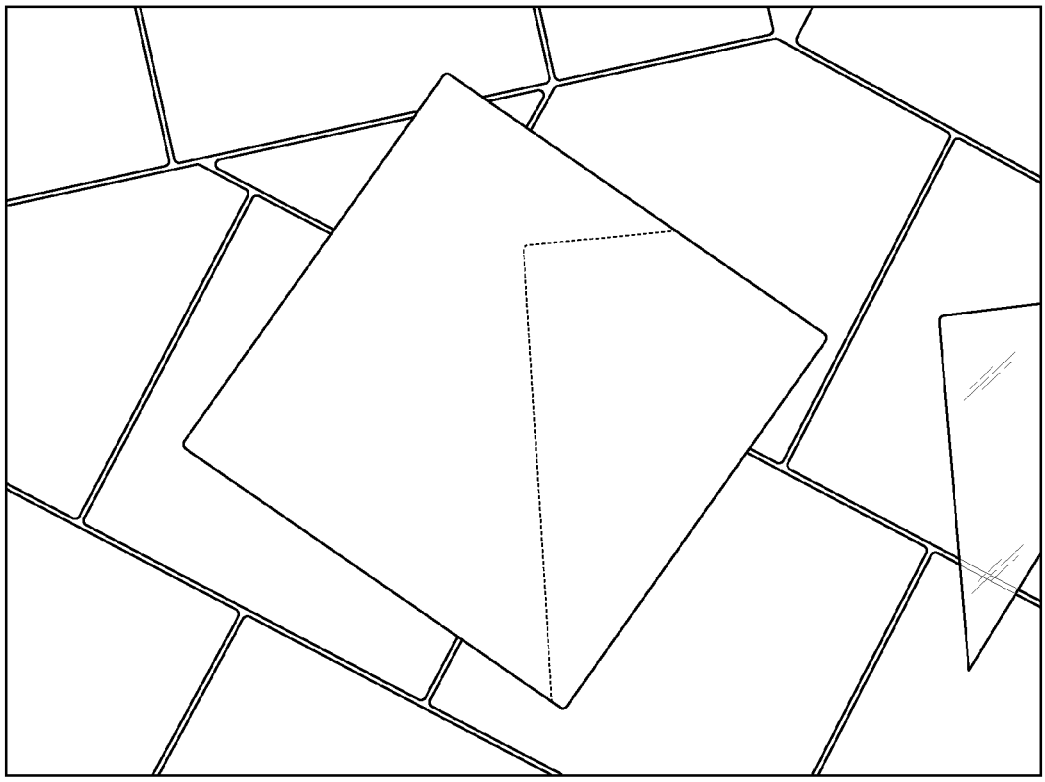
Figure 50:
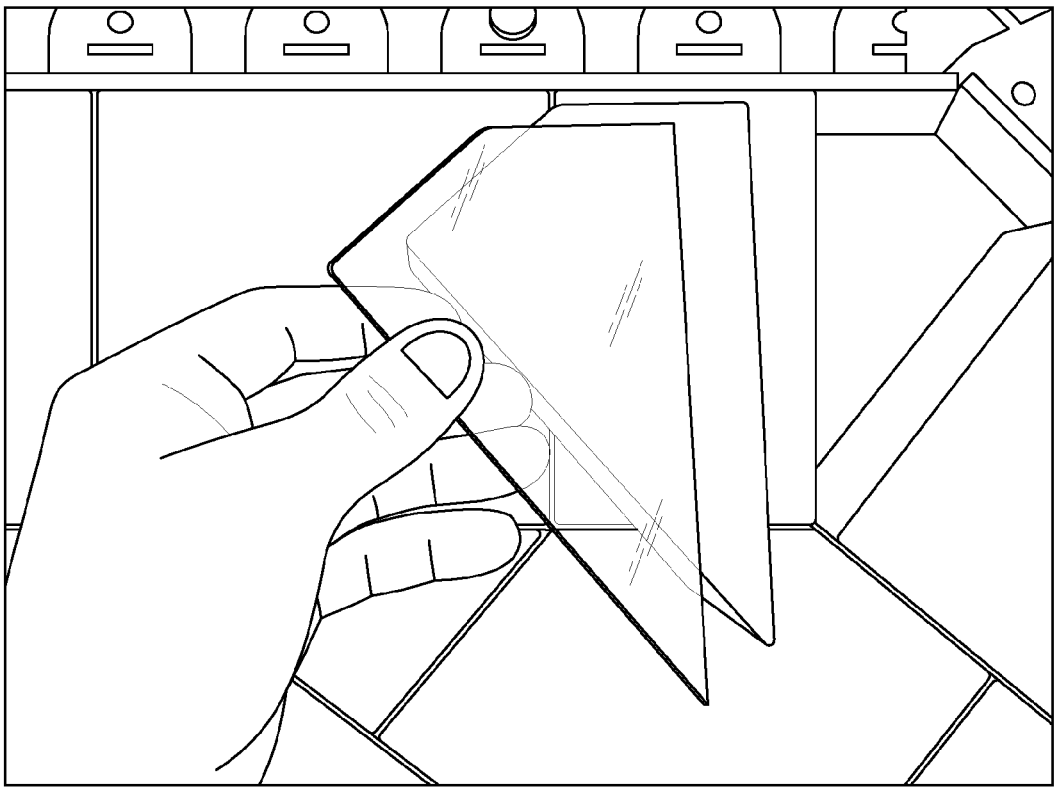
Figure 51:
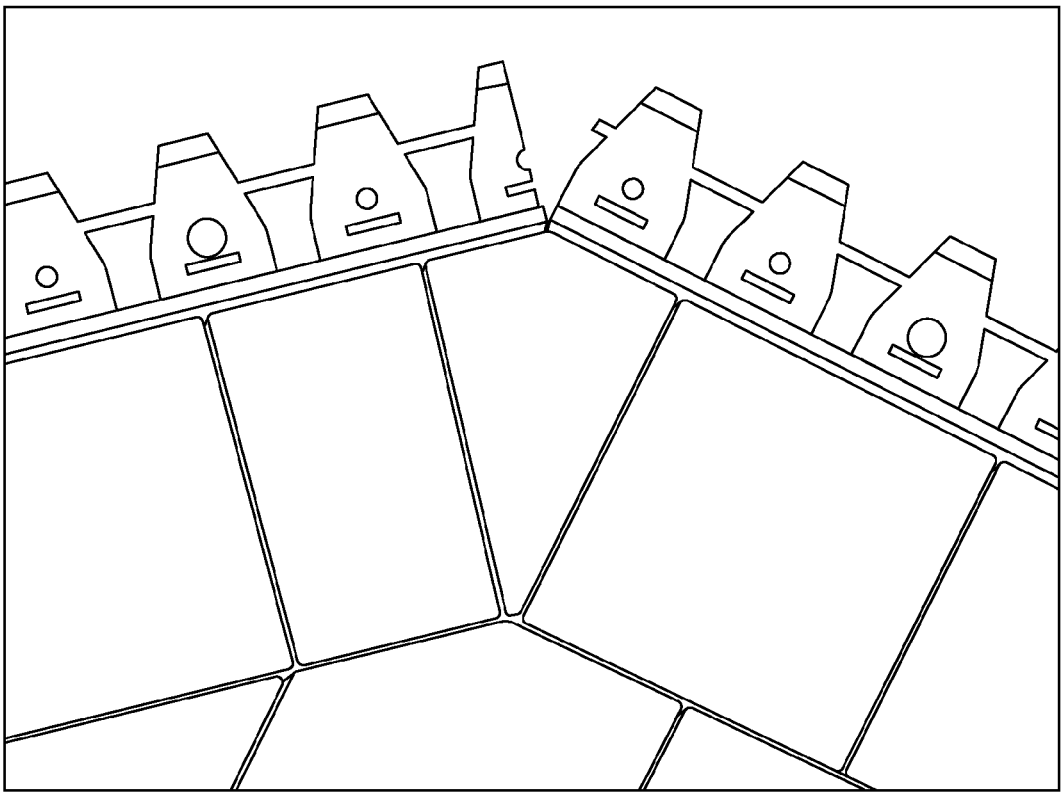
Figure 52:
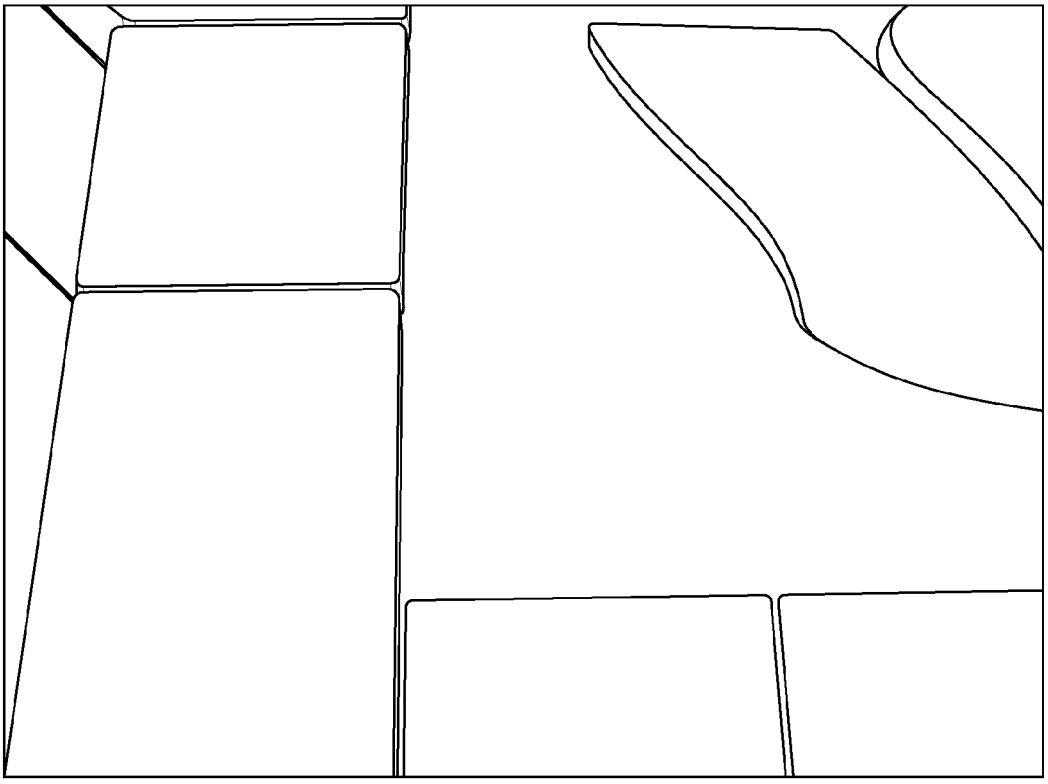
FIGS. 52-58 illustrate how to use the jig member with the pins and tracing sheets to facilitate an odd shape cut.

For example, now referring to FIGS. 44-51, the measuring apparatus, system, and method is illustrated on how to use the jig member with the pins and tracing sheets to facilitate an irregular cut. Another example is shown on how to use the jig member and tracing sheets to provide an irregular triangular cut. Referring to FIG. 45, the jig member is set against the adjacent block or tile and is secured by tapping the secure pins into the floor of gravel. The transparent tracing sheet is then placed into the two bracing clips or spring clamps. In this example, one side of the jig is set against the brick leaving the second side of the jig standing free. However, the jig is designed to reflect a 90 degree angle. When the tracing sheet is placed into the spring clamps, it extends that 90 degree angle outward. As shown in the top right corner of FIG. 45, the angle of that brick line runs in perfect alignment with the tracing sheet. Referring to FIG. 46, a level is used as straight edge to trace the outline of the cut on to the transparent sheet. Referring to FIG. 47, the jig member is pulled out and the blue marker lines indicate the traced cut to be made. Referring to FIG. 48, the transparent sheet has been traced, cut, and checked for size. Referring to FIG. 49, the brick is marked for cutting. Note, the existing 90 degree angle right corner of the brick is used to reduce cutting. Referring to FIG. 50, the transparent template is placed alongside and on top of the cut brick. Referring to FIG. 51, the brick has been cut and set in place.

Figure 53:
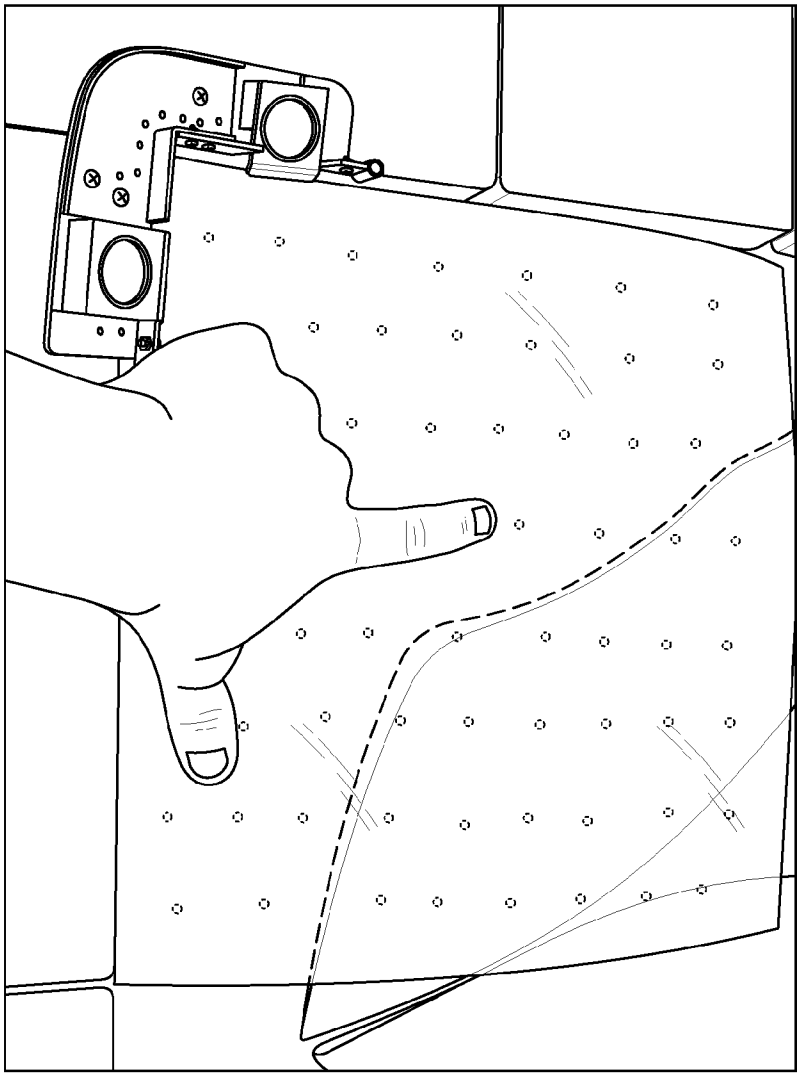
Figure 54:
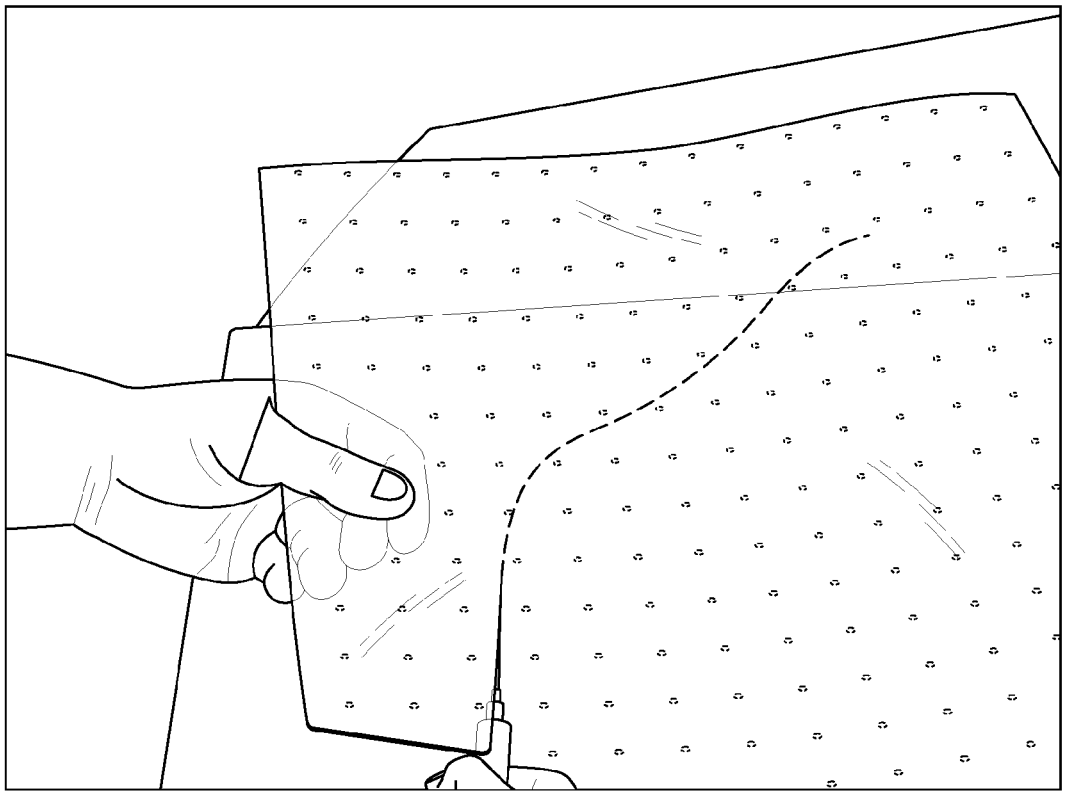
Figure 55:
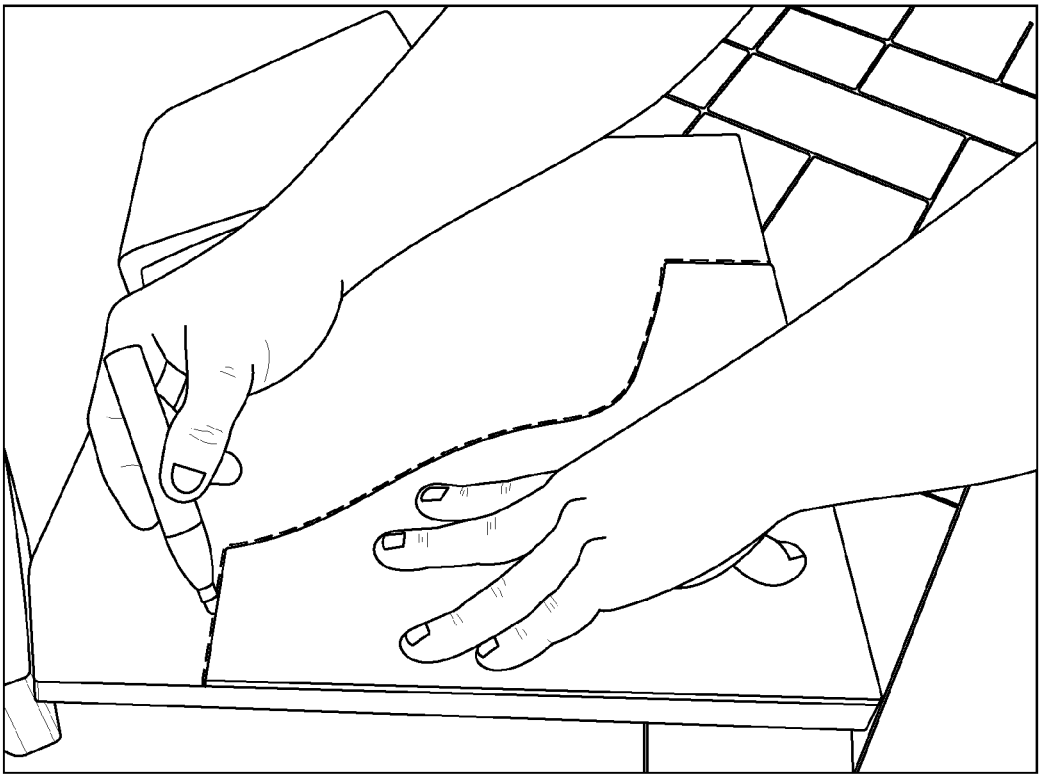
Figure 56:
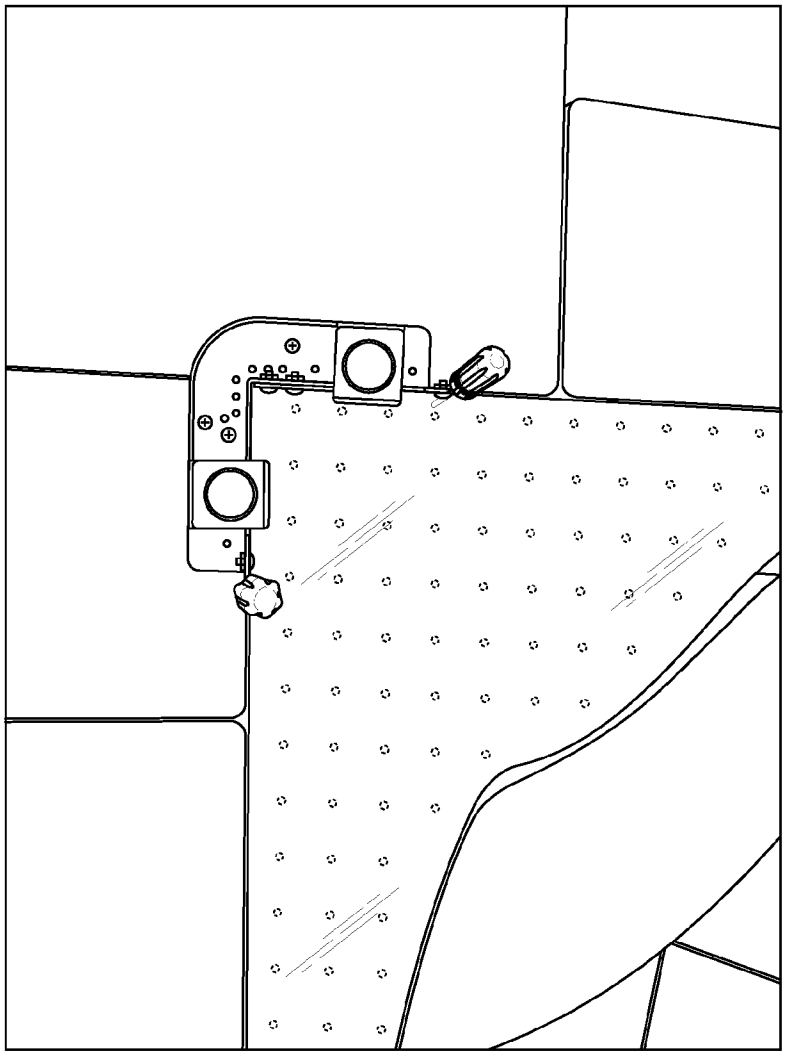
Figure 57:
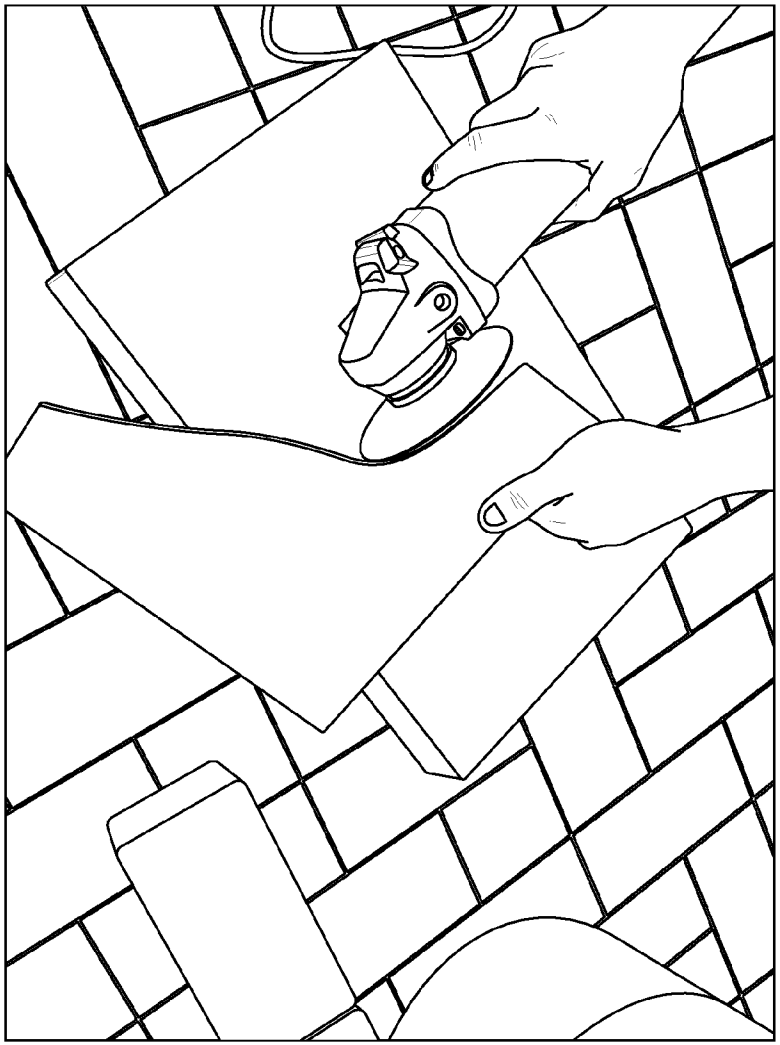
Figure 58:
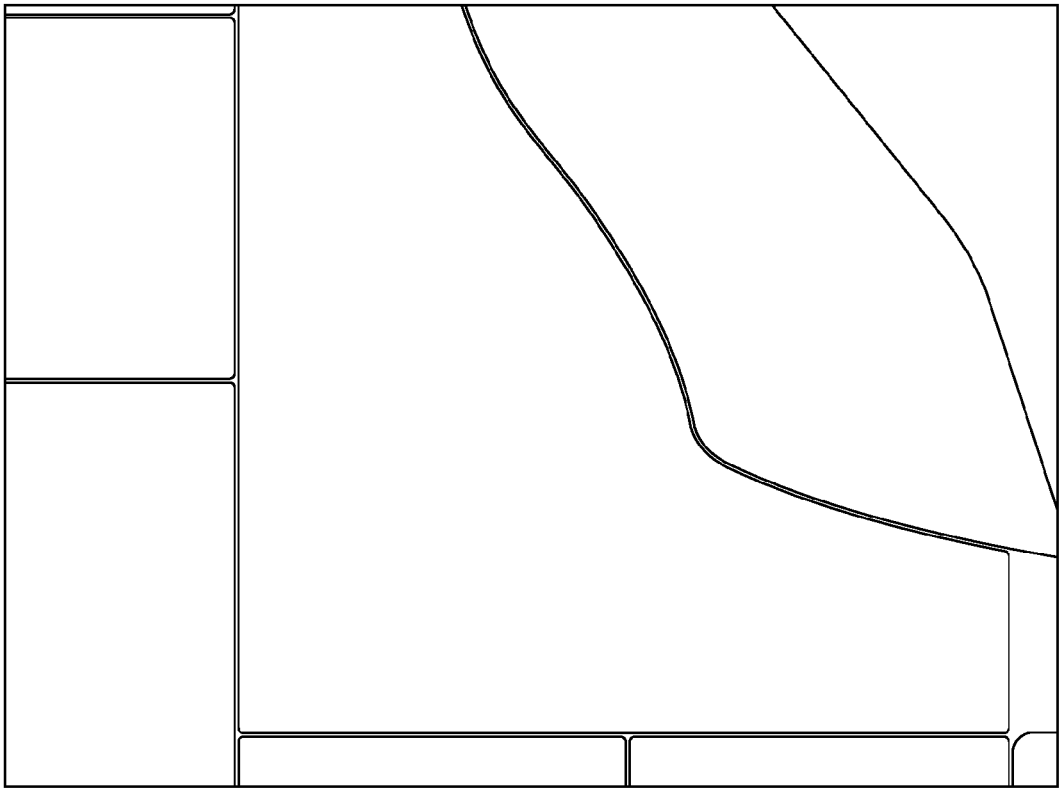
Figure 59:
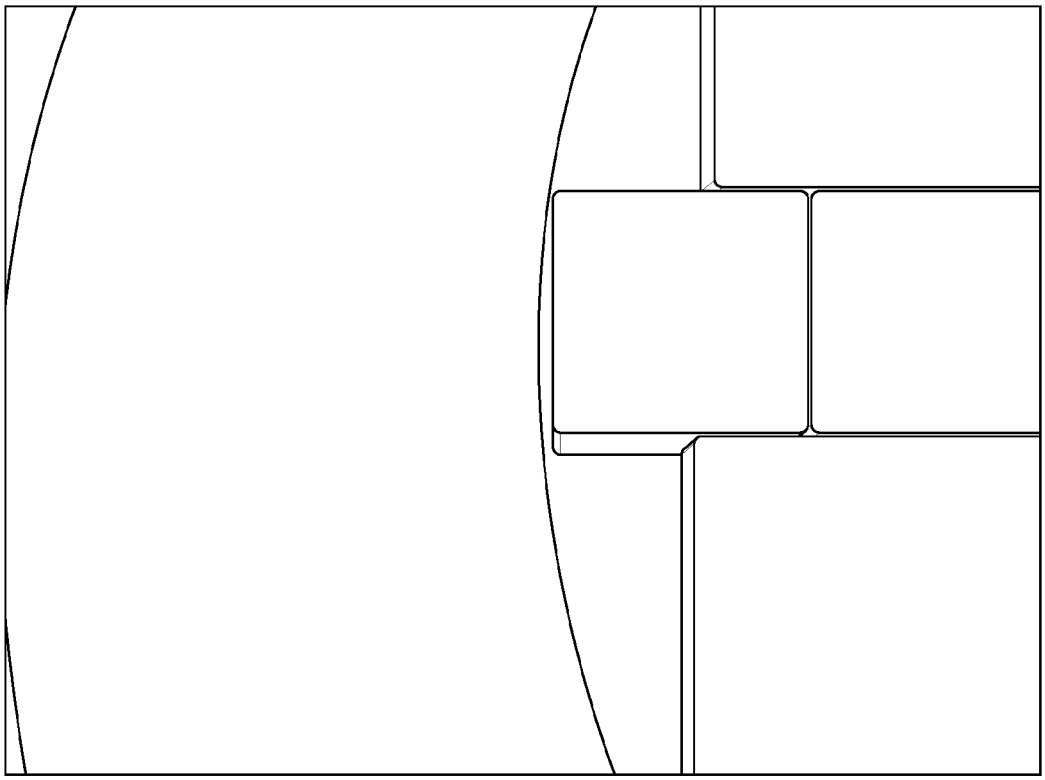
FIGS. 59-64 illustrate how to use the jig member with the pins and tracing sheets to facilitate another type of radius cut.

For example, now referring to FIGS. 52-58, the measuring apparatus, system, and method is illustrated on how to use the jig member with the pins and tracing sheets to facilitate an odd shape cut. Another example is shown of how to use the jig member and tracing sheets to provide an odd shape cut of natural stone or slate tile transitioned into 90 degree angle. Referring to FIG. 53, the jig member is set against the 90 degree angle of the adjacent paver or tile and secured in place by tapping the secure pins in place. The transparent tracing sheet is then placed into the two spring clamps. The outline of the odd shape is viewed through the transparent tracing sheet and drawn with marker. Referring to FIG. 54, the irregular shape is then cut from the tracing sheet. Referring to FIG. 55, the cut tracing sheet is then placed over the stone and lined up at all corners and then the outline of the irregular shape is drawn with marker onto the stone. Referring to FIG. 56, the cut sheet is positioned back into the jig to check the fit. Referring to FIG. 57, the irregular shape is then cut from the stone using a grinder or other cutting tool. Referring to FIG. 58, the new cut natural stone is now put into place.

Figure 60:
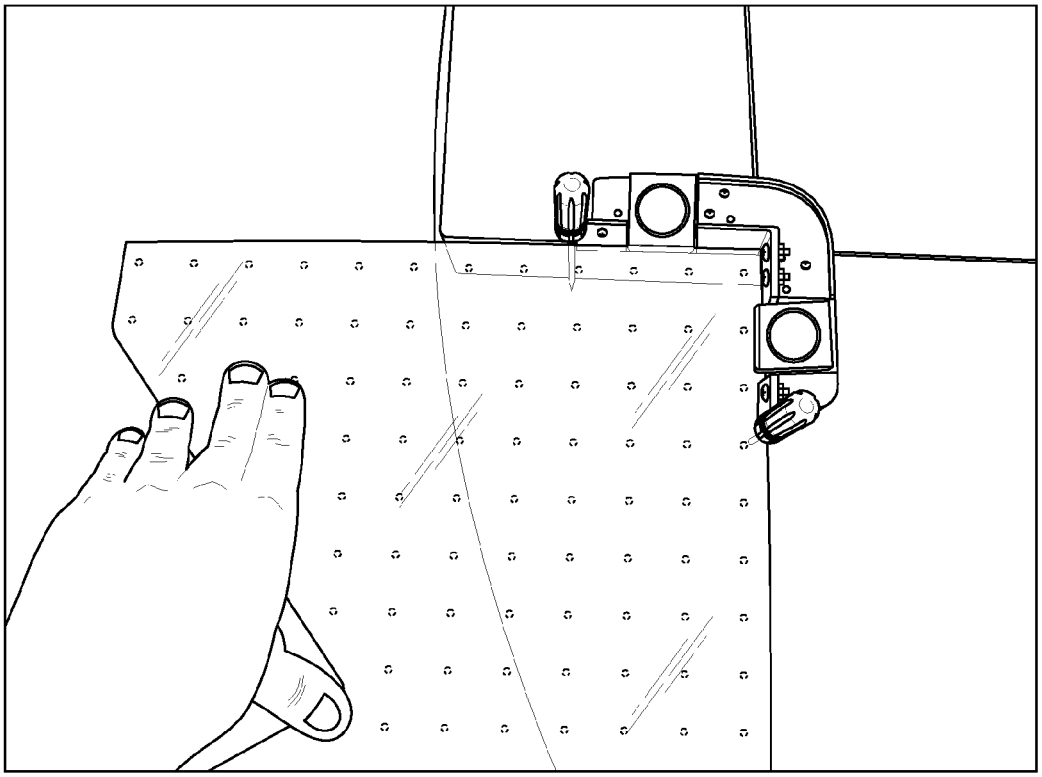
Figure 61:
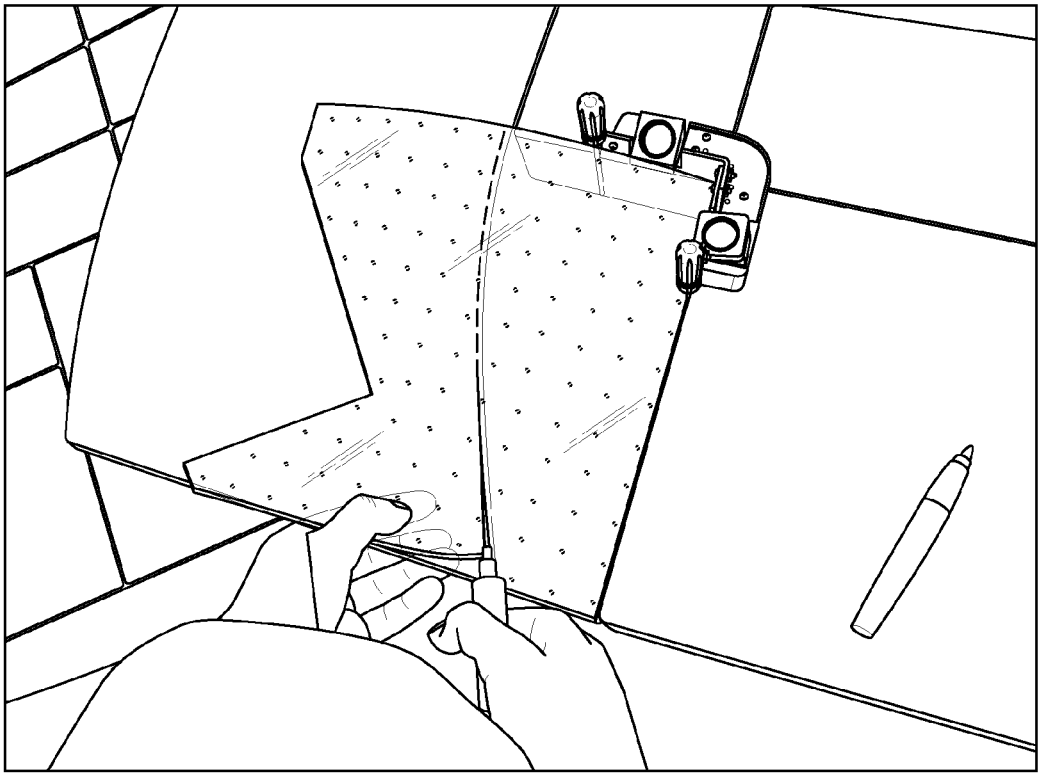
Figure 62:
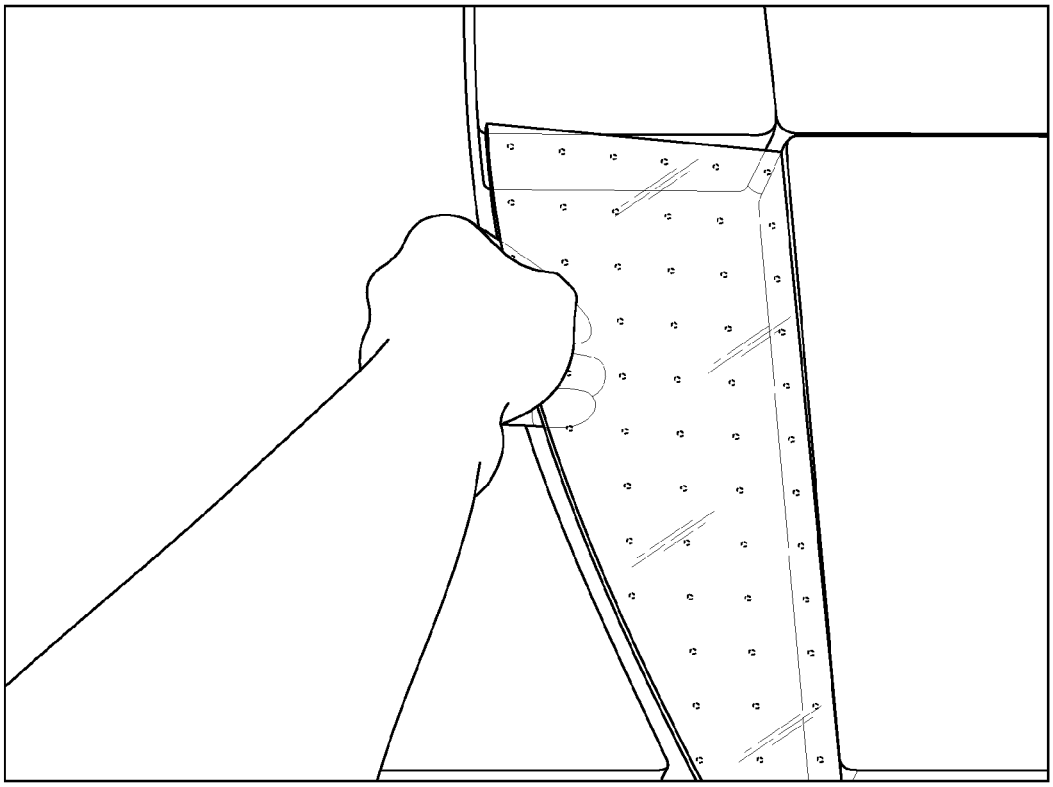
Figure 63:
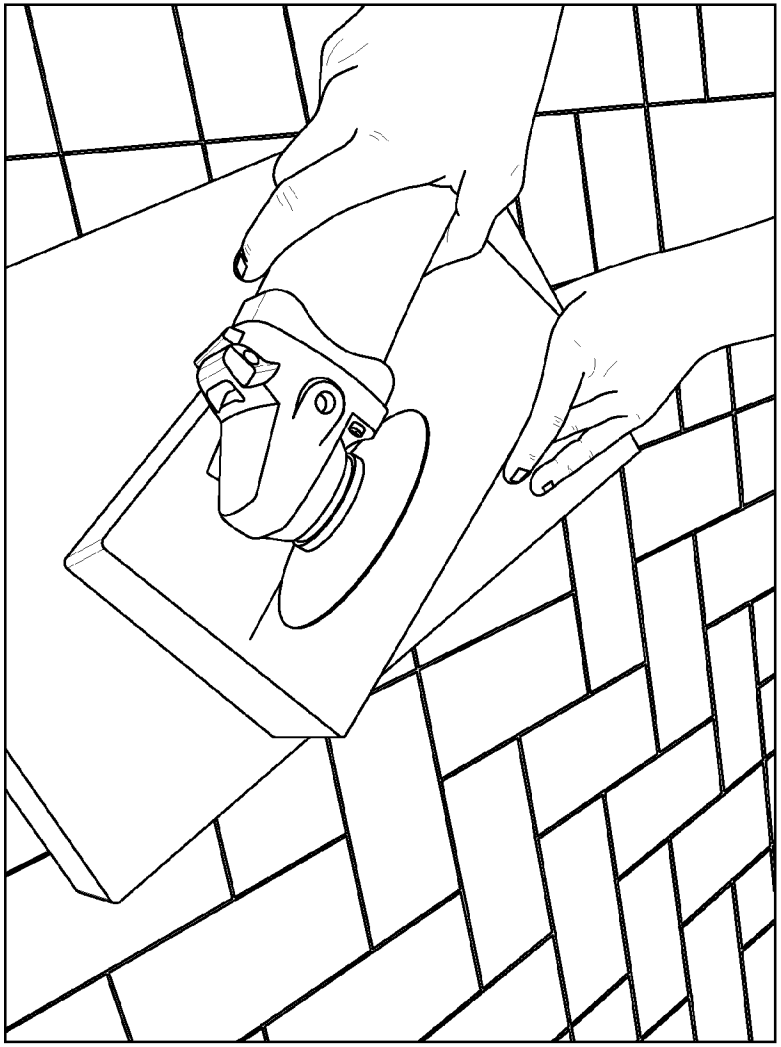

For example, now referring to FIGS. 59-64, the measuring apparatus, system, and method is illustrated on how to use the jig member with the pins and tracing sheets to facilitate another type of radius cut. Another example is shown of how to use the jig and tracing sheets to provide an example of a radius cut working material, such as bricks, block, or tile. Referring to FIG. 60, the jig member is set to the 90 degree angle of the adjacent bricks or tile and is secured in place by tapping the secure pins into the floor or gravel. The transparent tracing sheet is then placed into the two spring clamps. Referring to FIG. 61, the transparent tracing sheet is cut along the mark radius line. Referring to FIG. 62, the cut sheet fit is checked. Referring to FIG. 63, the brick is cut with a grinder or other cutting tool. Referring to FIG. 64, the cut brick or tile is placed in position.

It should be appreciated that the present invention of the jig member and tracing sheets maybe used for measuring and cutting any working materials may encompass additional methods beyond those disclosed herein. In addition, the jig member may be used with or without the secure pins. The secure pins may be used with or without the jig member or tracing sheets. The tracing sheets may be used alone, or with the secure pins, or with the jig member, or both with the secure pins and jig member.

In another embodiment, the present invention may be a kit which includes tracing sheets and one or more of the following items: marker, jig, secure pins, level, ruler, scissors, cutting knife, or other items that may be used in conjunction with the measuring apparatus.

It would be appreciated by those skilled in the art that various changes and modifications can be made to the illustrated embodiments without departing from the spirit of the present invention. All such modifications and changes are intended to be covered by the appended claims.

What is claimed is:

1. A measuring apparatus for measuring cuts of a working material, comprising:

one or more transparent tracing sheets configured for marking a cut area, the one or more transparent tracing sheets having one or more receiving areas, and the one or more transparent tracing sheets including an outline of the cut area; and one or more pins configured for receipt within the one or more receiving areas of the one or more transparent tracing sheets, the one or more pins configured to engage a surface area for selectively fixing the one or more transparent tracing sheets in place over the cut area;

wherein the pins engage the surface area to facilitate marking the one or more transparent tracing sheets with the outline of the cut area to use in measuring and cutting of the working material.

2. The measuring apparatus of claim 1, further comprising:

a jig member coupled to the one or more transparent tracing sheets includes one or more cylinder mounts; and the one or more pins are configured for receipt within the one or more cylinder mounts.

3. The measuring apparatus of claim 2, wherein the jig member includes one or more spring clamps; and the one or more transparent tracing sheets are configured for receipt within the one or more spring clamps.

4. A method for using a measuring apparatus to facilitate cuts of a working material, comprising:

providing a measuring apparatus comprising one or more transparent tracing sheets;

engaging the measuring apparatus proximal to a cut area to be measured; and marking the one or more transparent sheets with a trace line outlining the cut area to use in measuring and cutting of the working material.

5. The method of claim 4, wherein the measuring apparatus comprises one or more pin.

6. The method of claim 5, wherein the measuring apparatus comprises a jig member.

7. The method of claim 4, further comprising:

cutting the one or more transparent tracing sheets along the trace line to create a void in the one or more transparent tracing sheets in a shape of the cut area.

8. The method of claim 7, further comprising:

placing the one or more transparent tracing sheets on the working material; and marking the working material with a cut line outlining the void in the one or more transparent tracing sheets to transfer the shape of the cut area to the working material.

9. The method of claim 8, further comprising:

cutting the working material along the cut line to provide the working material in the shape of the out area.

10. The measuring apparatus of claim 1, wherein the working material is selected from the group consisting of tile, brick, concrete, ceramics, stone, drywall, and wood.

11. The measuring apparatus of claim 1, wherein the outline of the cut area is a line on the one or more transparent tracing sheets.

12. The measuring apparatus of claim 1, wherein the outline of the cut area is a void formed in the one or more transparent tracing sheets.

13. The method of claim 5, wherein the working material is selected from the group consisting of tile, brick, concrete, ceramics, stone, drywall, and wood.

14. A method of creating a template for cutting a working material to fill a target area, the method comprising the steps of:

providing a transparent sheet that is larger than the target area;

overlaying the transparent sheet on the target area;

tracing the target area onto the transparent sheet to create a pattern that substantially matches the target area; and cutting along the pattern to create a void in a shape of the target area in the transparent sheet.

15. The method of claim 14, further comprising the steps of:

forming at least one opening in the transparent sheet; and engaging at least one pin through the at least one opening to secure the at least one transparent sheet over to the target area.

16. The method of claim 14, further comprising the step of overlaying the void in the transparent sheet over the working material.

17. The method of claim 14, further comprising the steps of:

forming at least one opening in the transparent sheet; and engaging at least one pin through the at least one opening to secure the void in the at least one transparent sheet to the working material.

18. The method of claim 14, further comprising the step of tracing the void onto the working material.

19. The method of claim 14, further comprising the step of cutting the working material in the shape of the void.

20. The method of claim 14, wherein the working material is selected from the group consisting of tile, brick, concrete, ceramics, stone, drywall, and wood.

* * * * *